US008562233B2

(12) United States Patent
Castellani et al.

(10) Patent No.: US 8,562,233 B2
(45) Date of Patent: Oct. 22, 2013

(54) CONTAINER HAVING A TOOL RETAINER, CONTAINER CARRYING A COSMETIC ACCESSORY, AND ASSOCIATED COSMETIC ACCESSORY AND TREATMENT METHOD

(75) Inventors: Cynthia Castellani, Plainfield, NJ (US); Jim Jegou, Millton, NJ (US); Anthony Drouin, Sucy-en-Brie (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 13/108,113

(22) Filed: May 16, 2011

(65) Prior Publication Data

US 2011/0286782 A1 Nov. 24, 2011

Related U.S. Application Data

(63) Continuation of application No. 12/892,963, filed on Sep. 29, 2010, now abandoned.

(60) Provisional application No. 61/253,083, filed on Oct. 20, 2009, provisional application No. 61/247,043, filed on Sep. 30, 2009.

(51) Int. Cl.
*A46B 11/00* (2006.01)

(52) U.S. Cl.
USPC ..... 401/125; 401/123; 220/735; 215/390

(58) Field of Classification Search
USPC ..... 401/123–125, 137; 220/735–376; 215/390–391; 206/581; 132/290
See application file for complete search history.

(56) References Cited

U.S. PATENT DOCUMENTS

| | | | | |
|---|---|---|---|---|
| 2,374,092 | A * | 4/1945 | Glaser | 215/6 |
| 3,443,710 | A | 5/1969 | Hills | |
| 4,592,478 | A * | 6/1986 | Laconis | 220/23.83 |
| 4,835,813 | A | 6/1989 | Lorenzana et al. | |
| 4,881,648 | A | 11/1989 | Hagerty | |
| 5,316,398 | A * | 5/1994 | Chandaria et al. | 401/18 |
| 6,231,258 | B1 * | 5/2001 | Kingsley | 401/123 |
| 6,298,863 | B1 * | 10/2001 | Byun | 132/294 |

(Continued)

FOREIGN PATENT DOCUMENTS

| | | |
|---|---|---|
| DE | 88 13 057 | 12/1988 |
| FR | 0288347 A1 * | 10/1988 |

(Continued)

OTHER PUBLICATIONS

Partial European Search Report issued Mar. 29, 2011, in EP 10 18 3741, filed Sep. 30, 2010.

(Continued)

*Primary Examiner* — David Walczak
*Assistant Examiner* — Jennifer C Chiang
(74) *Attorney, Agent, or Firm* — Oblon, Spivak, McClelland, Maier & Neustadt, L.L.P.

(57) ABSTRACT

The present invention relates generally to packaging. In one embodiment the invention concerns a container having a tool retainer incorporated therein. In another embodiment the invention relates to a container of the type having a hollow envelope defining internally a chamber suitable for a product such as a cosmetic product, the hollow envelope defining externally a receiving housing for an accessory such as a cosmetic accessory; and an accessory, such as a cosmetic accessory, designed to be received removably in the receiving housing, the accessory having at least a part that is more flexible than the hollow envelope.

19 Claims, 20 Drawing Sheets

(56) References Cited

U.S. PATENT DOCUMENTS

| | | | | |
|---|---|---|---|---|
| 6,302,608 | B1 * | 10/2001 | Holmes et al. | 401/125 |
| 6,419,123 | B2 * | 7/2002 | Colquhoun | 222/192 |
| 6,652,176 | B2 * | 11/2003 | Dumler | 401/125 |
| 6,722,805 | B1 | 4/2004 | Skinner | |
| D505,748 | S * | 5/2005 | Angeletta | D28/7 |
| 7,178,533 | B2 * | 2/2007 | Andrion | 132/308 |
| 7,328,788 | B2 * | 2/2008 | Mahieu et al. | 206/5.1 |
| 2005/0019086 | A1 * | 1/2005 | Haneda | 401/123 |
| 2005/0081879 | A1 | 4/2005 | Andrion | |
| 2007/0009315 | A1 * | 1/2007 | Wu | 401/123 |
| 2008/0056803 | A1 * | 3/2008 | McKay | 401/123 |

FOREIGN PATENT DOCUMENTS

| | | |
|---|---|---|
| WO | WO 82/00576 | 3/1982 |
| WO | WO 99/28201 | 6/1999 |
| WO | WO 2005/039660 | 5/2005 |

OTHER PUBLICATIONS

French Search Report, Issued May 5, 2010 in FR 09 56807, filed Sep. 30, 2009.

* cited by examiner

CONTAINER HAVING A TOOL RETAINER, CONTAINER CARRYING A COSMETIC ACCESSORY, AND ASSOCIATED COSMETIC ACCESSORY AND TREATMENT METHOD

REFERENCE TO PRIOR APPLICATIONS

This application is a Continuation of U.S. application Ser. No. 12/892,963, filed Sep. 29, 2010; which claims priority to U.S. provisional application Ser. No. 61/247,043, filed Sep. 30, 2009 and U.S. provisional application Ser. No. 61/253,083, filed Oct. 20, 2009; and to French patent application 09 56807, filed Sep. 30, 2009, all incorporated herein by reference.

FIELD OF THE INVENTION

The present invention relates generally to packaging.

In one embodiment the present invention concerns a container having a tool retainer incorporated therein.

In another embodiment the present invention relates to a container of the type comprising:

- a hollow envelope defining internally a chamber suitable for a product such as a cosmetic product, the hollow envelope defining externally a receiving housing for an accessory such as a cosmetic accessory; and
- an accessory, such as a cosmetic accessory, designed to be received removably in the receiving housing, the accessory comprising at least a part that is more flexible than the hollow envelope.

BACKGROUND OF THE INVENTION

Containers often require the application of the contents to a substrate. For example, cleansers and cosmetics require the application of the product to the skin. Often, the method of application or treatment can be as efficacious as the contents themselves. Such methods often involve the use of a separate tool that is not easily stored or transported with the container.

In terms of cosmetics or cleansers, providing a rough, abrasive surface serves to thoroughly cleanse and exfoliate the skin. Accordingly, some consumers prefer to use a reusable wash cloth to apply cleansers. Others prefer disposable towelettes that have cleansers contained therein. These towelettes can be pre-moistened or require the addition of water. Further, some consumers use brushes, some of which are motorized.

However, such devices have numerous disadvantages in terms of storage and transport. Reusable wash cloths, once wet, must be dried before they can be stored or transported. Further, reusable wash cloths must be properly laundered between uses to prevent bacterial growth. Disposable towelettes can only be used once and must be discarded after use. This adds to cost and is also not ecologically friendly. Storage and transport are not easily facilitated in that they are packaged in bulky containers and require a great deal of space. Also, if the consumer does not transport a sufficient number of the towelettes, the consumer must purchase additional towelettes. Brushes can be more advantageous than reusable wash cloths in terms of retaining the reusability aspect while reducing bacteriological growth. However, they are not easily stored or transported. Motorized brushes have the added disadvantage in that they require batteries, which adds to cost and is also not very ecologically friendly. In addition, motorized brushes cannot be easily stored in wet areas such as a bathroom or shower due to the risk of electrical malfunction.

Accordingly there is a desire to provide a tool that is ecologically friendly, reusable, safe and cost conscious. Further, it is also desirable to provide a reusable cleansing tool that is easily stored and transported.

The foregoing needs are met, to a great extent, by the present invention, wherein in one aspect a container is provided having a tool retainer for accommodating a tool. Further, a reusable tool is provided that is configured to rest in the tool retainer. Thus, the coordinating container and tool greatly facilitate the storage and transport of the container and tool in one system.

U.S. Pat. No. 5,558,453 describes a container that has a hollow envelope defining a chamber for soap and a brush carried by a support that snaps onto the hollow envelope. The brush is more flexible than the hollow envelope.

To attach the cosmetic accessory to the container, the brush support snaps into housings formed in the hollow envelope. This attachment of the cosmetic accessory to the hollow envelope is robust. The cosmetic accessory is therefore held firmly to the hollow envelope defining the chamber, notably during its transport or storage.

Such a container is not entirely satisfactory: the robustness of the attachment between the accessory and the hollow envelope can make it difficult to detach the cosmetic accessory and occasion some difficulty to the user.

Moreover, the container is made bulky by the attachment of the accessory to the hollow envelope.

GB 2 392 898, FR 2 066 293, US 2005/0067414, and EP 0 288 347 describe other containers that are not designed to receive a cosmetic product.

It is therefore an object of the invention to provide a container suitable for containing a cosmetic product and carrying a cosmetic accessory, the container being simple and easy to use, yet carrying the accessory in a robust manner.

Another object of the invention is to provide a container of this kind that is as compact as possible.

DETAILED DESCRIPTION OF THE PREFERRED EMBODIMENTS

Figure 1:
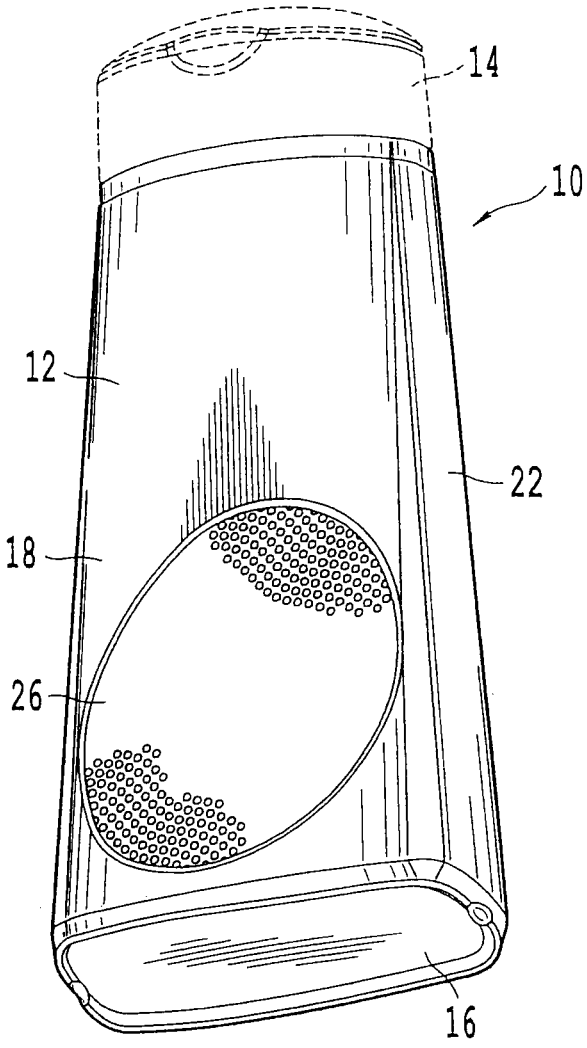
FIG. 1 is a perspective view of a container system, according to a preferred embodiment of the present invention.

In the description that follows the term "means" is used simply to describe preferred embodiments herein, to which the invention is not limited. Examples include certain "retention means", which are simply particularly preferred embodiments of the invention retainer, and "means for removably fastening the tool", which are simply preferred embodiments of the invention fastener for removably fastening the tool. As for the claims, interpretation under 35 U.S.C. 112, $6^{th}$ paragraph, is intended only when the term "means" is used in the claims in a manner that invokes such interpretation.

In one embodiment of the present invention, a container includes a housing having a first wall and a second wall remote therefrom, a depth d associated with a distance between the first and second walls, and an aperture in the housing configured to retain a tool, wherein the aperture extends between the first and second walls and has a varying size along the depth d.

In another embodiment of the present invention, a container system includes a tool that includes a first end, and a second end remote therefrom, and a container that includes a housing having a first wall and a second wall remote therefrom, a depth d associated with a distance between the first and second walls, and an aperture in the housing configured to retain a tool, wherein the aperture extends between the first and second walls and has a varying size along the depth d.

In still another embodiment of the present invention, a container includes a housing having a first wall and a second wall remote therefrom, and a recession at the first wall, extending toward the second wall, at a depth d, configured to retain a tool, wherein a size of the recession varies along the depth d.

In an embodiment of the present invention, a container is provided having a tool retainer for accommodating a tool. Further, a reusable tool is provided that is configured to rest in the tool retainer.

As is usual, the invention will be described in part herein with reference to the drawing figures, in which like reference numerals refer to like parts throughout.

Figure 2:
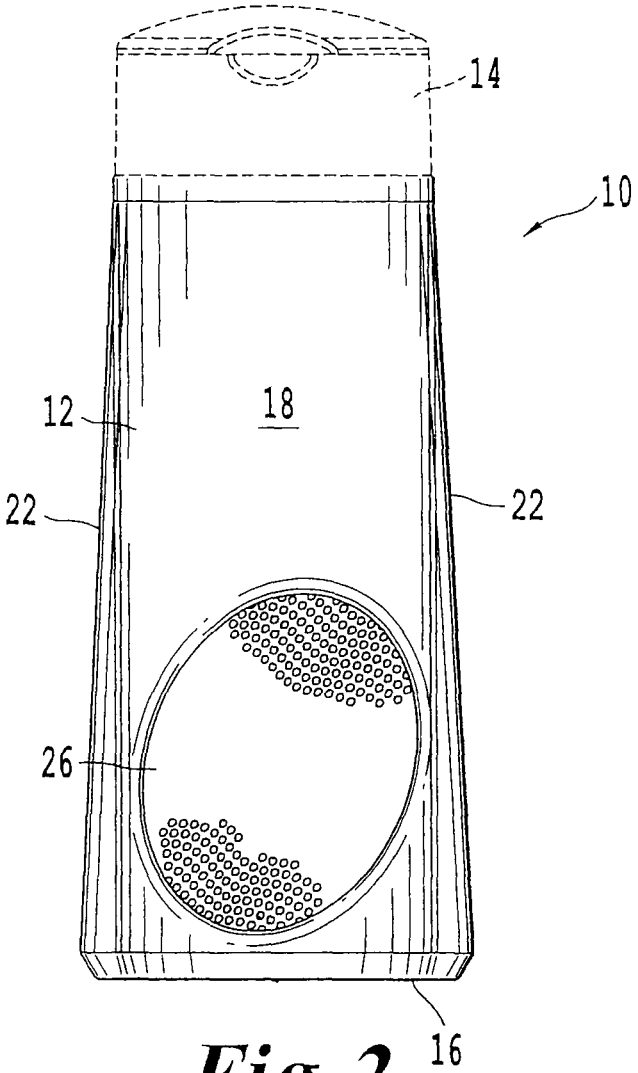
FIG. 2 is a front view of the container system of FIG. 1.
Figure 3A:
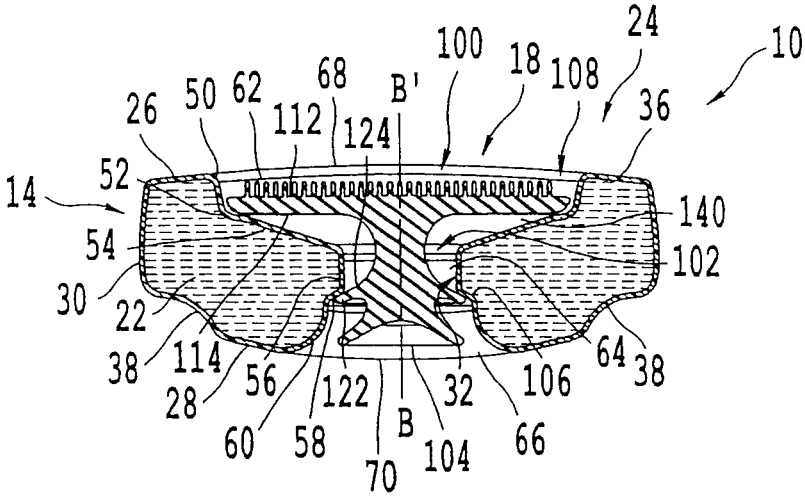
FIG. 3*a* is a view seen in section on the horizontal plane III-III perpendicular to the plane marked II-II in FIG. 1*a;*
Figure 3:
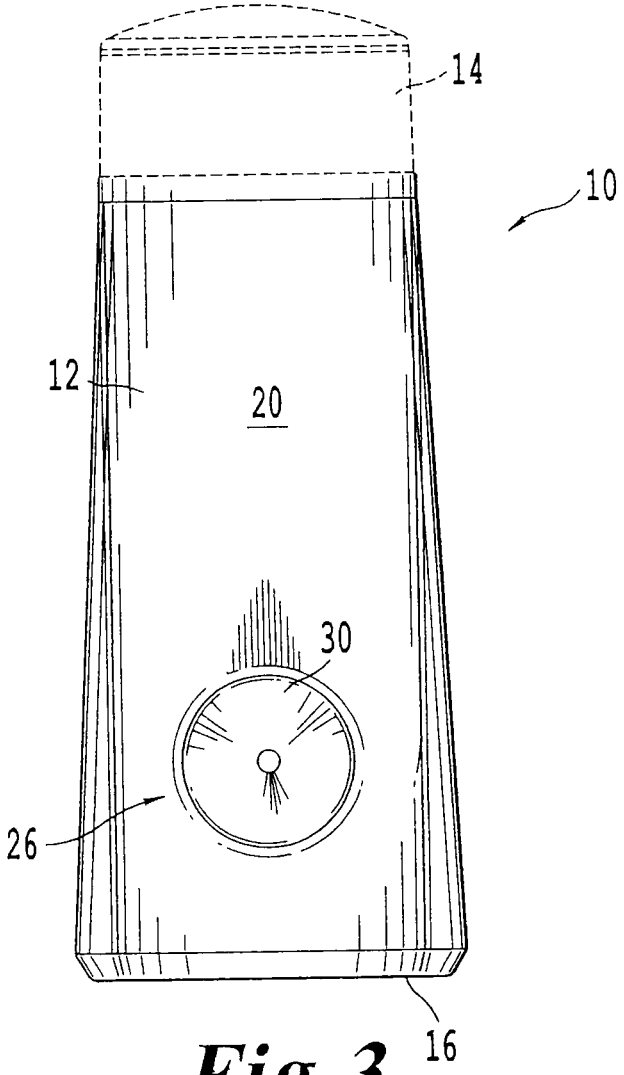
FIG. 3 is a rear view of the container system of FIG. 1.

In an embodiment of the present invention, a container system 10 is presented, with reference to FIGS. 1-3. A container 12 is shown having a dispenser end 14 and a closed end 16. Further, the container 12 includes a front wall 18 and a rear wall 20 remote therefrom. Connecting the front wall 18 and the rear wall 20 are two side walls 22.

In one embodiment of the present invention, the front wall 18, rear wall 20 and side walls 20 may be formed integrally in one step. Alternatively, the container walls may be formed separately and then be fastened together, either removably or separately. The container may be formed of any suitable materials, but preferably a thermoplastic material.

As shown in FIGS. 4-7, the container 12 includes a tool retainer 24. In one embodiment of the present invention, the tool retainer 24 can be a cavity or depression formed at either the front or rear walls 18, 20, respectively. In another embodiment, the tool retainer 24 can be an aperture going entirely through the container's depth, from the front wall 18 to the rear wall 20. In a preferred embodiment of the invention, the aperture or recession is formed to conform to the shape of the tool to be inserted and retained in the container system 10. Thus, the specific configuration of the retainer 24 will mirror the dimensions and specific configuration of the tool. Accordingly, various alterations and dimensions are possible for both the tool and the tool retainer 24, without deviating from the spirit and scope of the present invention.

Figure 8A:
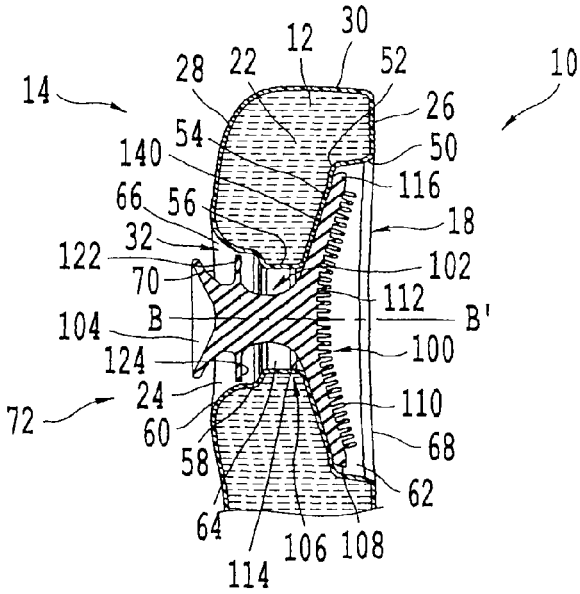
FIG. 8*a* is a view similar to FIG. 7*a* in a later stage in the insertion of the cosmetic accessory into the receiving housing.
Figure 8:
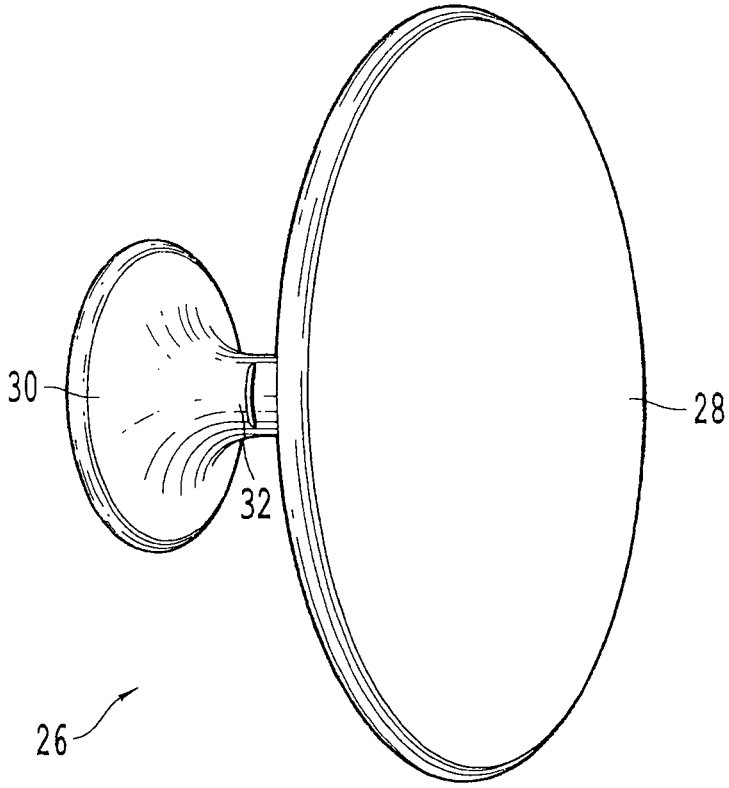
FIG. 8 is a perspective view of a tool, according to a first embodiment of the present invention.
Figure 9:
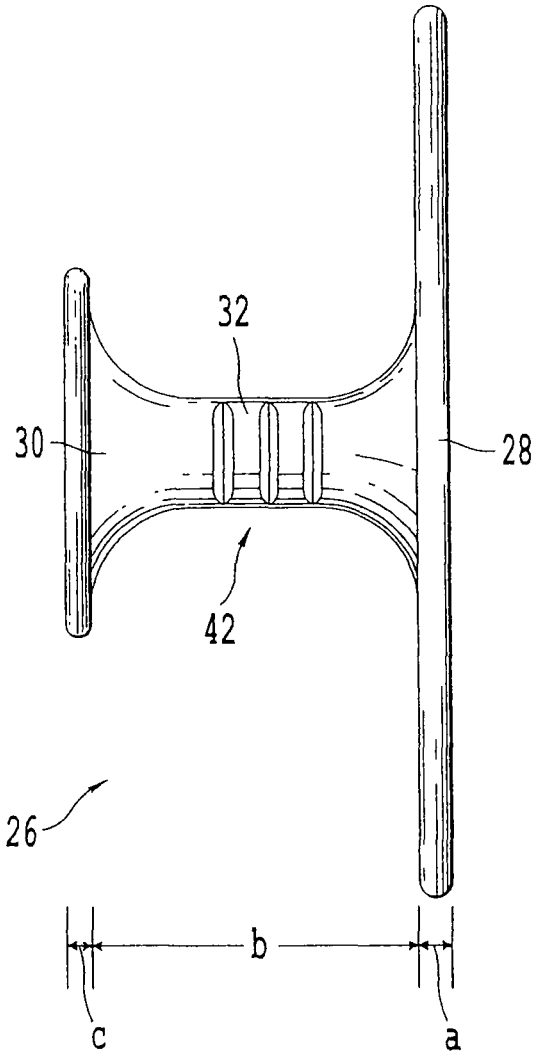
FIG. 9 is a side view of the tool of FIG. 8.

Although various configurations are possible, in one embodiment of the present invention, a tool 26 as shown in FIGS. 8-9, has a general shape of a spool. The tool 26 has a first end 28, a second end 30 remote therefrom, and a stem 32 connecting the first and second ends, 28, 30. In an embodiment of the present invention, the first end 28 can include an abrasive surface. Such an abrasive surface can be in the form of bristles, nubs, and the like. The abrasive surface is the surface a user would employ to clean the skin or apply the contents of the container. Thus the tool 26 can be any type of applicator, scrubber or the like. Further, the surface of the first end 28 can contain no features and be smooth, depending on the function to be served. For example, if the tool is to serve only the purpose of applying the contents to a substrate, it may be desirable to include no abrasive surface on the first end 28.

The second end 30, alone or in combination with the stem 32, can serve as a handle or gripper means for the user. In a preferred embodiment of the present invention, the second end 30 contains a suction cup feature. The suction cup feature enables the tool 26 to be used in a shower or bathroom. It is contemplated that a user can apply, or treat the skin or desirable surface and then attach the tool 26 to the wall of the shower or bathroom mirror using the suction cup feature, or any appropriate surface. In another embodiment of the present invention, the second end 30 need not incorporate the suction cup feature. Rather, the second end 30 can incorporate a number of other features facilitating ease and convenience for the consumer. For example, the second end can include a means for removably fastening to a shower caddy. A hook, a hole for attaching the tool 26 to a string, or any like feature can be incorporated.

The stem 32 can be any length as desired. Further the stem 32 can be formed integrally with the first and second ends 28, 30 respectively, or be formed separately therefrom and then coupled thereto. Lastly, the stem 32 need not be present. For example the second end 30 may simply be formed on a back end of the first end 28.

Although the first end 28 is shown having an oval shape, with a uniform thickness, any variety of shapes, sizes, thicknesses or configurations may be employed. Similar variations can be utilized for the second end 30 as well. Likewise, the stem 32 can have a generally cylindrical configuration with a constant radius or a varying radius. The shape of the stem 32 can also be non-cylindrical.

Figure 10:
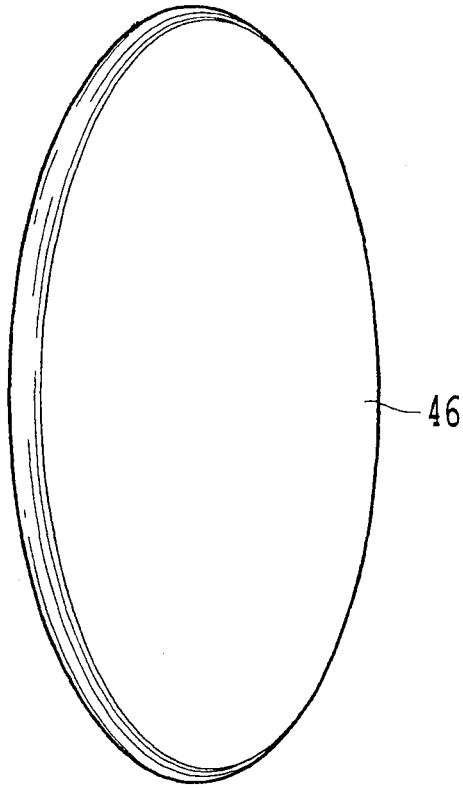
FIG. 10 is a perspective view of a tool according to a second embodiment of the present invention.
Figure 11:
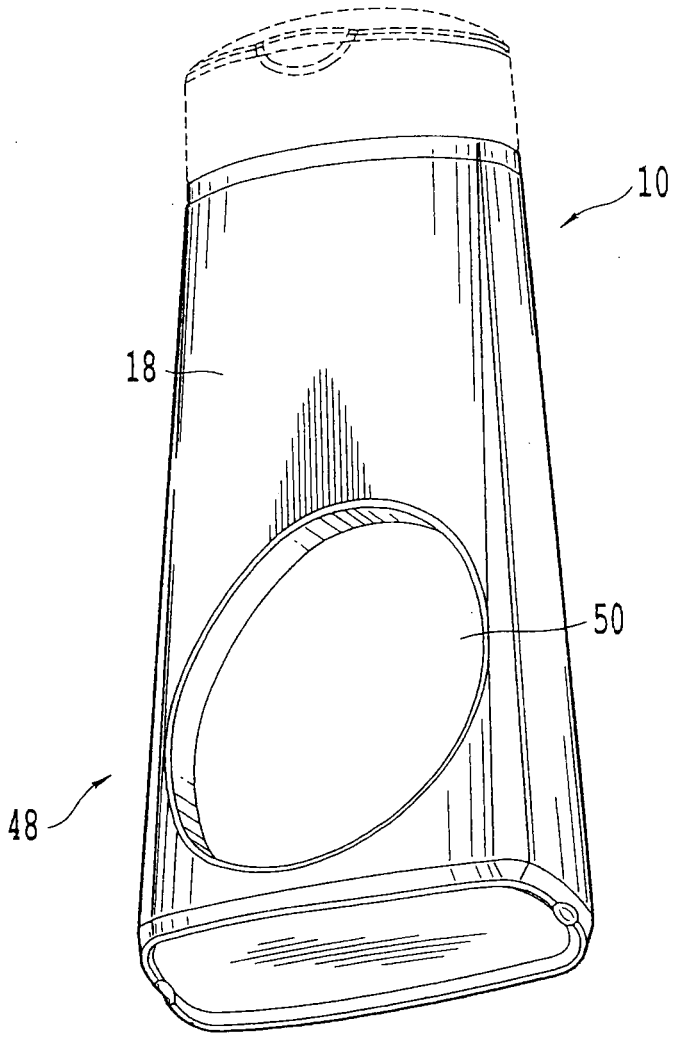
FIG. 11 is a perspective view of a container, according to a second embodiment of the present invention.
Figure 12:
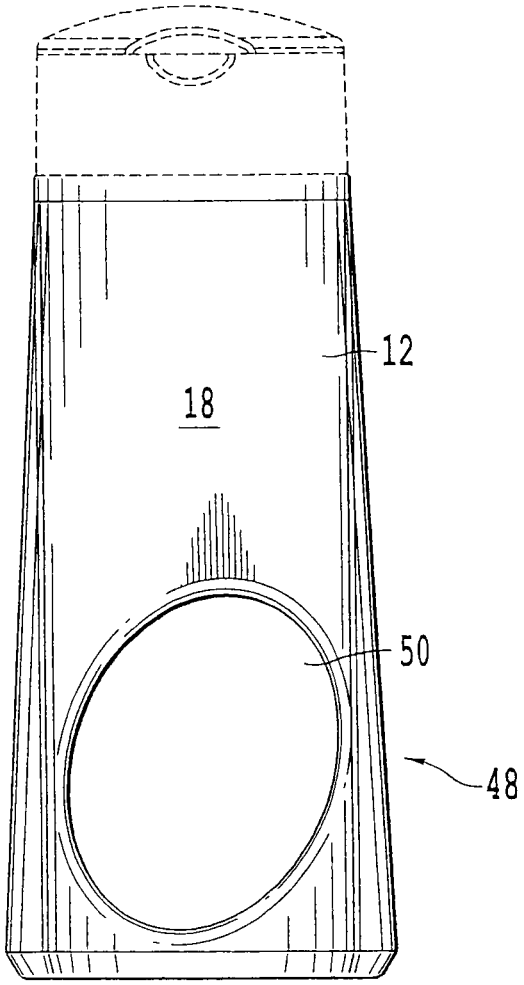
FIG. 12 is a front view of the container of FIG. 11.
Figure 13:
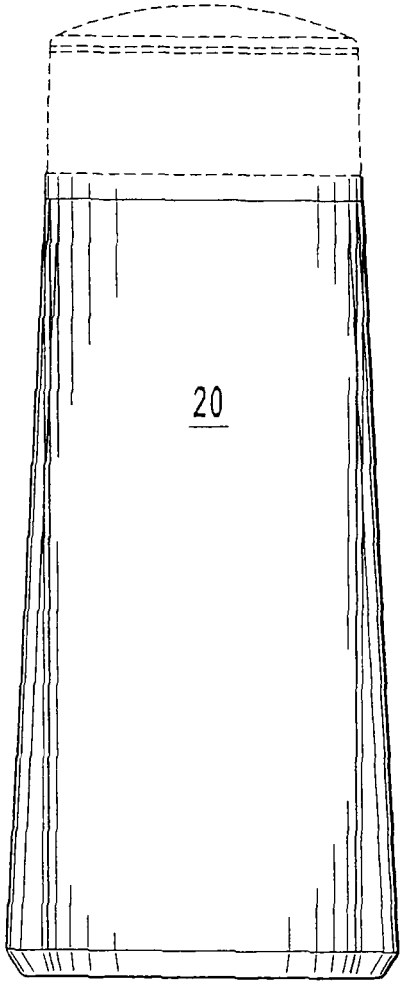
FIG. 13 is a rear view of the container of FIG. 11.
Figure 14:
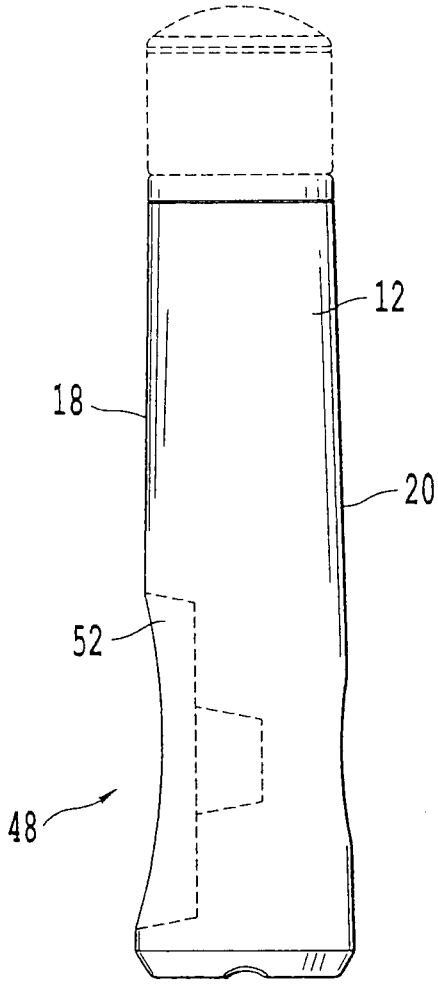
FIG. 14 is a side view of the container of FIG. 11.

In this embodiment, a first end, a second end and a stem are illustrated and described. However, any number of shapes and sizes are conceivable and consistent with the scope of this invention. For example, the tool 26 need not be limited to a circular shape or oval shape. The shape of the tool 26 can be varied and modified as previously discussed. For example, the tool 26 can be elongated and have a peanut shape so that one side of the tool can serve as a handle. Numerous possibilities exist for the shape, configuration, features and final look of the tool 26. The images of the tool 26 in FIGS. 8-10 are included for illustrative purposes for a preferred embodiment and to discuss the corresponding features of the tool retainer 24 of the container 12.

Returning to FIGS. 4-7, the container 12 generally has an aperture that serves as a tool retainer 24. The tool retainer 24 is advantageous for a number of reasons. First, it is a simple matter to include an applicator tool or scrubber tool with the container. Further, this serves as an advantage for the manufacturer because it facilitates easy of packaging in providing the consumer two products in one. Transporting the products is also easily facilitated. The retailer also benefits in that they do not need to provide added shelf space and can provide two products in the space required for one.

The consumer has numerous benefits. First, the consumer need only purchase one unit and obtains an applicator or scrubber tool when purchasing the cleanser. Second, the type of tool appropriate for the purpose can be configured specifically for the container. This eliminates the customer having to research and decide what tool is appropriate. Further, the consumer can store the tool by placing it in the tool retainer 24, unlike packages of towelettes, washcloths or brushes. Next, the consumer can easily transport the cleanser and tool in one simple and easy system. Using a thermoplastic material for the tool 26 keeps the consumer from having to wait for the tool to dry, unlike with reusable wash cloths. The suction cup feature provides an added benefit in that the consumer can use the tool in the shower and easily store it in the shower by adhering the tool to the shower walls. The consumer can similarly use the tool at the sink to wash his or face and adhere the tool to the mirror. The tool is also reusable, ecologically friendly and does not require costly batteries. Further, use of the appropriate material can reduce or eliminate concerns of bacteriological growth.

In one embodiment previously discussed, the tool 26 has a spool-like shape. Therefore, the tool retainer 24 is configured to accommodate the shape of the tool 26 and also has a similar spool-like shape. Accordingly, as shown in FIGS. 4-7, the tool retainer 24 has a front wall recess 34 disposed at the front wall 18. The front wall recess 34 serves as a seat for the first end 28 of the tool 26. The front wall recess 34 can be any depth as desired. Preferably, the front wall recess 34 has a depth A that allows for the first end 28 of the tool 26 to be retained entirely therewith. Correspondingly, the first end 28 of the tool 26 has a thickness a, as shown in FIG. 9. Depth A can be at least as large as thickness a to prevent the tool 26 from protruding out of the tool retainer 24. Further, when the tool 26 is retained in the container 12, the first end 28 of the tool 26 can be flush with the front wall 18 of the container. However, in some applications, it may be advantageous to have the first end 28 of the tool 26 protrude from the container. In that event, the depth A of the front wall recess 34 can be less than the thickness a of the first end 28 of the tool 26.

Next, the tool retainer 24 can have an aperture 36 to accommodate the stem 32 of the tool 26. The aperture 36 is formed in the container 12 and exposes a generally cylindrical inner wall 38 of the container 12. Generally, the aperture 36 has a length B (FIG. 7) and shape corresponding to the length b and shape of the stem 32 (FIG. 9).

Figure 6A:
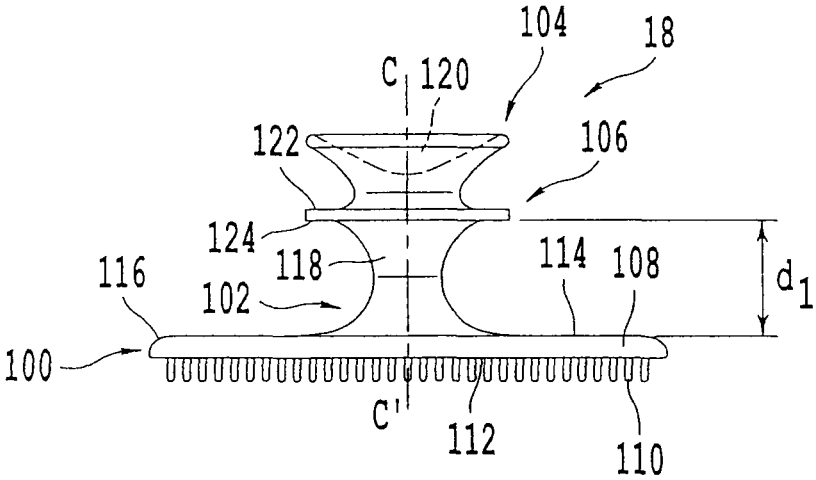
FIG. 6*a* is a side view of the cosmetic accessory carried in the container seen in FIG. 4*a;*
Figure 6:
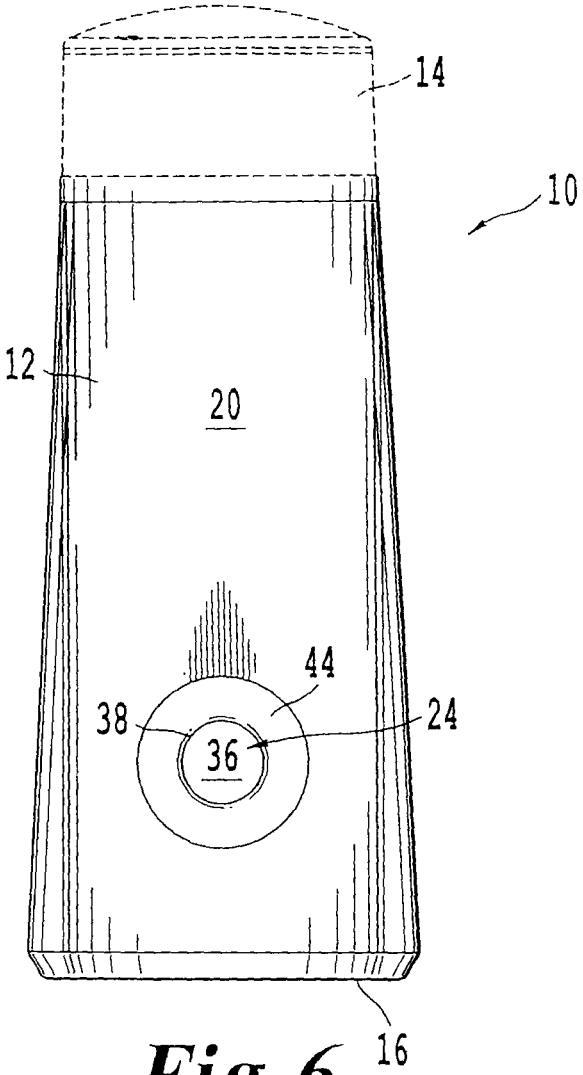
FIG. 6 is a rear view of the container of FIG. 4.
Figure 7:
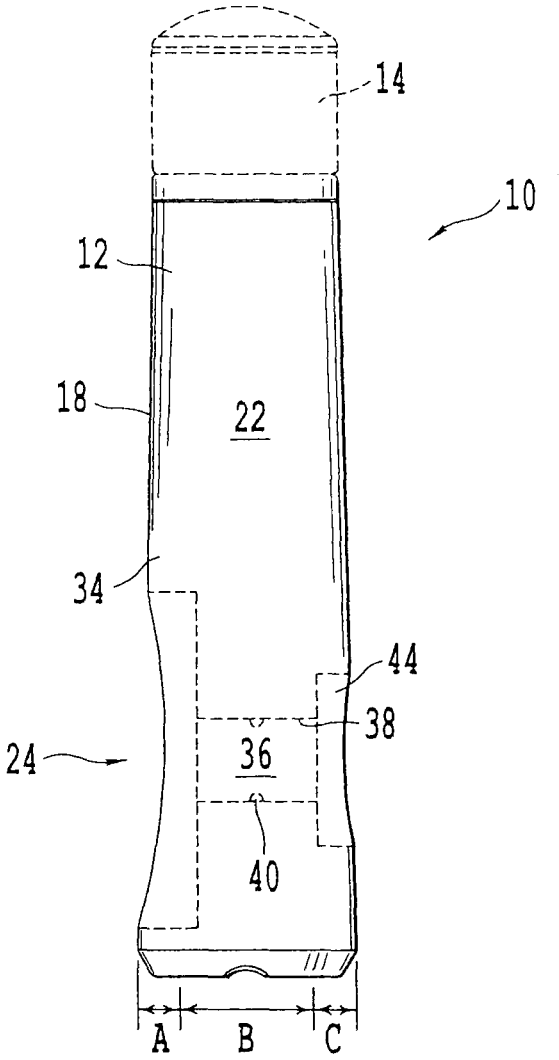
FIG. 7 is a side view of the container of FIG. 4.

Lastly, the tool retainer 24 can contain a rear wall recess 44, as shown in FIGS. 6-7. The rear wall recess 44 is similar to the front wall recess 34. The rear wall recess 44 is disposed at the rear wall 20 and is a recess formed therein. The rear wall recess 44 can be sized and shaped to accommodate the second end 30 of the tool 26. As with the front wall recess 34, the size and shape can vary according to the size and shape of the second end 30 of the tool 26. Further, the depth can vary depending on the desire to keep the second end 30 flush with the rear wall 20 as previously discussed. For example, a depth C (FIG. 7) of the rear wall recess 44 can be greater than the thickness of the second end c (FIG. 9).

In this embodiment, a front wall recess 34, a rear wall recess 44 and an inner wall 38 are illustrated and described. However, any number of recesses and inner walls are conceivable and consistent with the scope of this invention. Generally, the tool retainer 24 mirrors the shape and configuration of the tool 26.

The tool retainer 24 can contain various methods of removably fastening the tool 26 to the container 12. For example, the inner wall 38 can include a lip or flange 40 (FIG. 7) to retain the stem 32. In this instance, the stem 32 is snap-fitted into the inner wall 38 of the tool retainer 24. Such a flange 40 can be annular or be periodic. If the flange 40 is periodic, the fastening means will resemble tabs placed at the inner wall 38. Thus the stem 32 can be snap fitted into such tabs. The inner wall 38 can alternatively contain threads for threadably fastening the tool 26 to the tool retainer 24. Correspondingly, the stem 32 can also contain a corresponding fastening means such as, tabs, an annular ring, ridges or threads 42 to facilitate fastening to the tool retainer 24. Thus, it is preferred that the inner wall 38 and/or the tool 26 be configured with means for removably fastening the tool 26.

In a preferred embodiment, the inner wall 38 has a portion of reduced size. This reduced size allows the stem 32 to stay in place, when inserted into the tool retainer 24. Although the tool retainer 24 can be configured without having an aperture extending through the entire container, as will be discussed hereinafter, such a configuration has an added advantage. In the event the tool 26 is contained entirely within the container 12, allowing the tool 26 to be flush with the front and rear walls 18, 20, of the container, it may be difficult to pull the tool 26 out. In this instance, having the rear wall recess 34 permits the user to press on the second end 30 of the tool 26 at the rear wall recess 34 and drive it forward through the front wall recess 34 and out of the container 12.

The ability to keep the tool 26 retained entirely within the walls of the container 12 is advantages from a shipping and convenience standpoint. However, tabs may be formed either on the container 12 or the tool 26 to facilitate ease of removal. The tool 26 can also be retained in the container 12 such that a portion of the tool 26 does protrude out from the walls of the container 12 to facilitate the removal of the tool 26.

Further, the fastening means can be placed anywhere in the tool retainer 24 and need not be placed solely at the inner wall 28. For example, the fastening means can be placed in the front wall recess, the rear wall recess, or a combination of some or all of these locations. Similarly, the fastening means can be placed anywhere along the body of the tool 26.

Accordingly, the material used in forming the tool 26 should be flexible and pliable enough to accommodate insertion into the tool retainer 24, particularly the inner wall 38. However, the material should be rigid and strong enough to allow the inner wall 38 or the removable fastening means to retain the tool 26 within the tool retainer 24.

In the event that a stem 32 and/or second end 30 are not provided, according to an alternate embodiment, a tool 46, as shown in FIG. 10, resembles a flat disk or pancake shape. Such an alternate tool 46 can have any shape, size or configuration as desired.

In such instance, an alternate tool retainer 48 includes a shallow recession or nest 50 as shown in FIGS. 11-14. Such a nest 50 can also be shaped and dimensioned according to the shape and dimensions of the alternate tool 46. For example, the nest 50 can include a first nest recess 52 to accommodate the tool 46. Additional recesses can be formed according to the size and shape of the alternate tool 46. Thus, the nest 50 has a depth of less than a thickness of the container 12, as measured by the distance between the first and second walls 18, 20, respectively.

Fastening means to removably secure the tool 46 to the nest 50 can be employed in a manner similar to that disclosed earlier. As previously discussed, the fastening means can comprise threads, an annular lip, tabs or the like. Such fastening means can be disposed at the first nest recess 52 or any where along the inner wall of the nest 50. A portion of the nest 50 can have a reduced size to retain the alternate tool 46, as discussed previously. If the tool 46 is retained entirely within the container 12, such that the tool 46 is flush with the walls of the container 12, a means for removing the tool 46 from the container 12 may be employed. Alternatively, the tool 46 may be configured to protrude outside of the walls of the container 12 so as to facilitate removal.

Although the tool retainer 24 has been depicted toward the bottom of the container 12 at the container wall, the tool retainer 24 can be placed anywhere on the container. For example, the tool retainer 24 can be placed at the closed end 16 and be recessed within the closed end 16. In another example, the tool retainer 24 can be placed at the top of the container 12 near the dispenser end 14. In this instance, the tool retainer 24 can be incorporated into the dispenser itself. In another example, the tool retainer 24 can serve as a cap for the dispenser or be configured such that the tool itself can be used to as a plug to close the dispenser end 14. Further, the lid used to seal and unseal the container can include a nest or recession to accommodate the tool within the lid confines. Thus, the tool retainer need not be on the container body. Thus, many different variations can be employed in incorporating a tool retainer in a container.

In another embodiment of the present invention, a container includes a housing having a first wall and a second wall remote therefrom, a depth d associated with a distance between the first and second walls, and an aperture in the housing configured to retain a tool, wherein the aperture extends between the first and second walls and has a varying size along the depth d.

In yet another embodiment of the present invention, a container system includes a tool that includes a first end, and a second end remote therefrom, and a container that includes a housing having a first wall and a second wall remote therefrom, a depth d associated with a distance between the first and second walls, and an aperture in the housing configured to retain a tool, wherein the aperture extends between the first and second walls and has a varying size along the depth d.

In still another embodiment of the present invention, a container includes a housing having a first wall and a second wall remote therefrom, and a recession at the first wall, extending toward the second wall, at a depth d, configured to retain a tool, wherein a size of the recession varies along the depth d.

By "cosmetic product" is meant in particular a product as defined in Council Directive 93/35/EEC of 14 Jun. 1993.

A "cosmetic accessory" is in particular a cosmetic product applicator having an active part designed to come into contact with a body surface of a user in order to apply cosmetic product to this surface. A cosmetic accessory may for example be a cosmetic treatment tool such as a nail file or a massage roller, or a tool for assisting in the application of a cosmetic product, such as a mirror.

Another preferred embodiment of the invention is a container of the aforementioned type, characterized in that the hollow envelope comprises, in the receiving housing, retention means for retaining the cosmetic accessory, the whole of the cosmetic accessory being received in the receiving housing without projecting outside of the receiving housing beyond the hollow envelope when the cosmetic accessory is engaged in the retention means.

The container(s) according to the invention may have one or more of the following features, singly or in any technically possible combination:

- the cosmetic accessory comprises a retention surface that engages with the retention means when the cosmetic accessory is received in the receiving housing, the retention surface being deformable without significant deformation of the retention means when the cosmetic accessory is removed from the receiving housing;
- the whole of the cosmetic accessory is more flexible than the hollow envelope;
- the receiving housing is a through-housing;
- the through-housing opens out at a cosmetic accessory removal opening on one side of the hollow envelope, and opens out at a secondary opening on another side of the hollow envelope, opposite the removal opening, the secondary opening having in particular a cross section smaller than the cross section of the removal opening;
- the retention means comprise a first bearing surface for the cosmetic accessory and a second bearing surface for the cosmetic accessory, the bearing surfaces being separated axially along an axis along which the cosmetic accessory is removed from the receiving housing;
- the first bearing surface and the second bearing surface face in opposite directions to each other, the cosmetic accessory being held under tension between the first bearing surface and the second bearing surface when the cosmetic accessory is engaged in the retention means;
- the receiving housing defines a cosmetic accessory deforming space situated between the cosmetic accessory and the hollow envelope when the cosmetic accessory is engaged in the retention means, the cosmetic accessory being deformable in the deforming space without significant deformation of the retention means;
- the hollow envelope defines a back region that projects into the receiving housing transversely with respect to an axis along which the cosmetic accessory is removed from the receiving housing, the cosmetic accessory being situated at a distance from the back region when the cosmetic accessory is engaged in the retention means, and the back region advantageously diverging outwards away from the receiving housing;
- the receiving housing opens through a cosmetic accessory removal opening, the removal opening being defined by a surface of the hollow envelope that is basically planar all the way around the periphery of the removal opening;
- the outline of the receiving housing is closed on every cross section perpendicular to an axis of removal of the cosmetic accessory from the receiving housing;
- the cosmetic accessory comprises a sucker;
- the cosmetic accessory comprises an active part designed to come into contact with a body surface to carry out a cosmetic treatment of the surface, and a handle which projects from the active part, the cosmetic accessory also comprising a member for its retention on the hollow envelope, the retention member projecting from the handle and being at a distance from the active part;
- the cosmetic applicator is a single moulding, advantageously in a material with a hardness less than the material forming the hollow envelope;
- the accessory is chosen from a cosmetic product application tool comprising a cosmetic product applicator, a tool for the treatment of a body surface of a user, and a tool for assisting with the application of a cosmetic product;

the active part comprises a cosmetic product applicator; and the receiving housing and the cosmetic product chamber are totally separated from each other by the hollow envelope.

The invention further relates to a cosmetic accessory of the type comprising:

an active part designed to come into contact with a body surface to carry out a cosmetic treatment; and a handle that projects from the active part;

characterized in that the cosmetic accessory comprises a sucker on the free end of the handle and a retention member suitable for engaging with retention means on the container, the retention member projecting from the handle and being situated between the sucker and the active part.

The cosmetic accessory is advantageously suitable for reception in a container as defined above.

The accessory may have one or more of the features defined above.

The invention also relates to a cosmetic treatment method characterized in that it comprises the following steps:

provision of a container as defined above, the whole of the cosmetic accessory being received in the receiving housing, not projecting from the receiving housing beyond the hollow envelope, and being engaged in the retention means;

deformation of at least a part of the cosmetic accessory in the receiving housing, without significant deformation of the retention means, in order to release the cosmetic accessory from the retention means;

removal of the cosmetic accessory from the receiving housing; and application of the cosmetic accessory to a body surface in order to carry out a cosmetic treatment, especially after having applied a cosmetic product to the body surface.

Throughout the remainder of this text, the terms "front" and "rear" are used in a relative way with reference to the FIGS. 1*a* to 9*a*. The term "front" usually means nearer to the user, while the term "rear" usually means further away from the user.

A first container 10 according to the invention is shown in FIGS. 1*a* to 9*a*. This first container 10 is intended to contain a cosmetic product 12 with a view to its application to a body surface of a user.

The cosmetic product 12 is advantageously a liquid, a cream, a gel, or potentially a fluidized solid such as a powder. The cosmetic product may for example be a shampoo, a soap or a foaming cream.

The first container 10 according to the invention comprises a hollow envelope 14 containing the cosmetic product 12, a cosmetic product dispensing head 16 mounted on one end of the hollow envelope 14, and a cosmetic accessory 18 carried by the hollow envelope 14.

The container 10 also comprises, prior to its first use, a film 20 to protect the cosmetic accessory 18.

Figure 4:
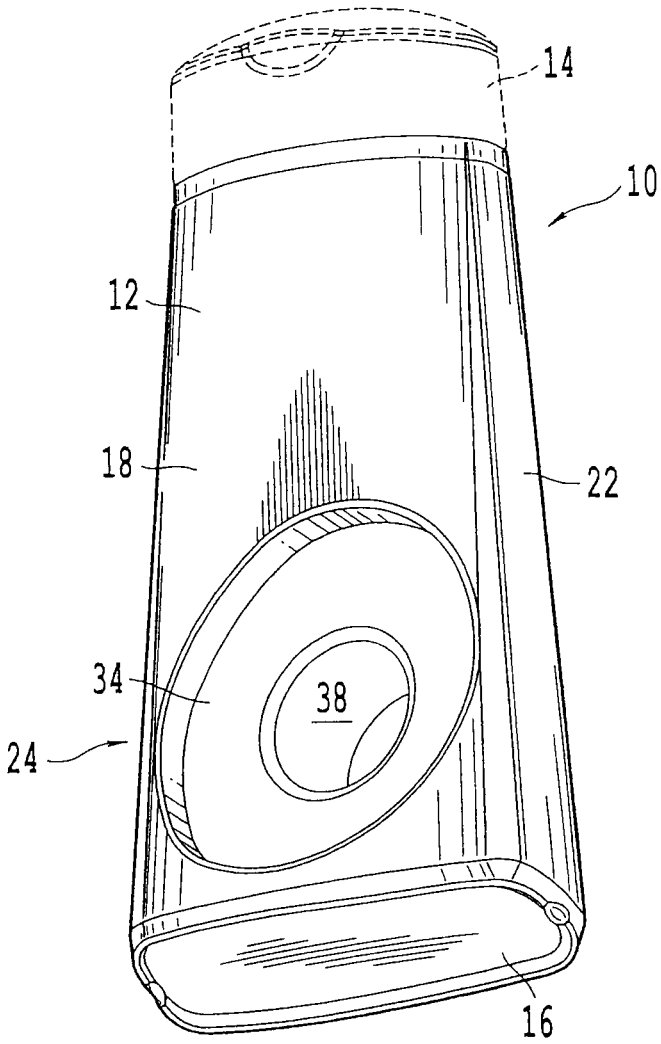
FIG. 4 is a perspective view of a container according to a first embodiment of the present invention.
Figure 4A:
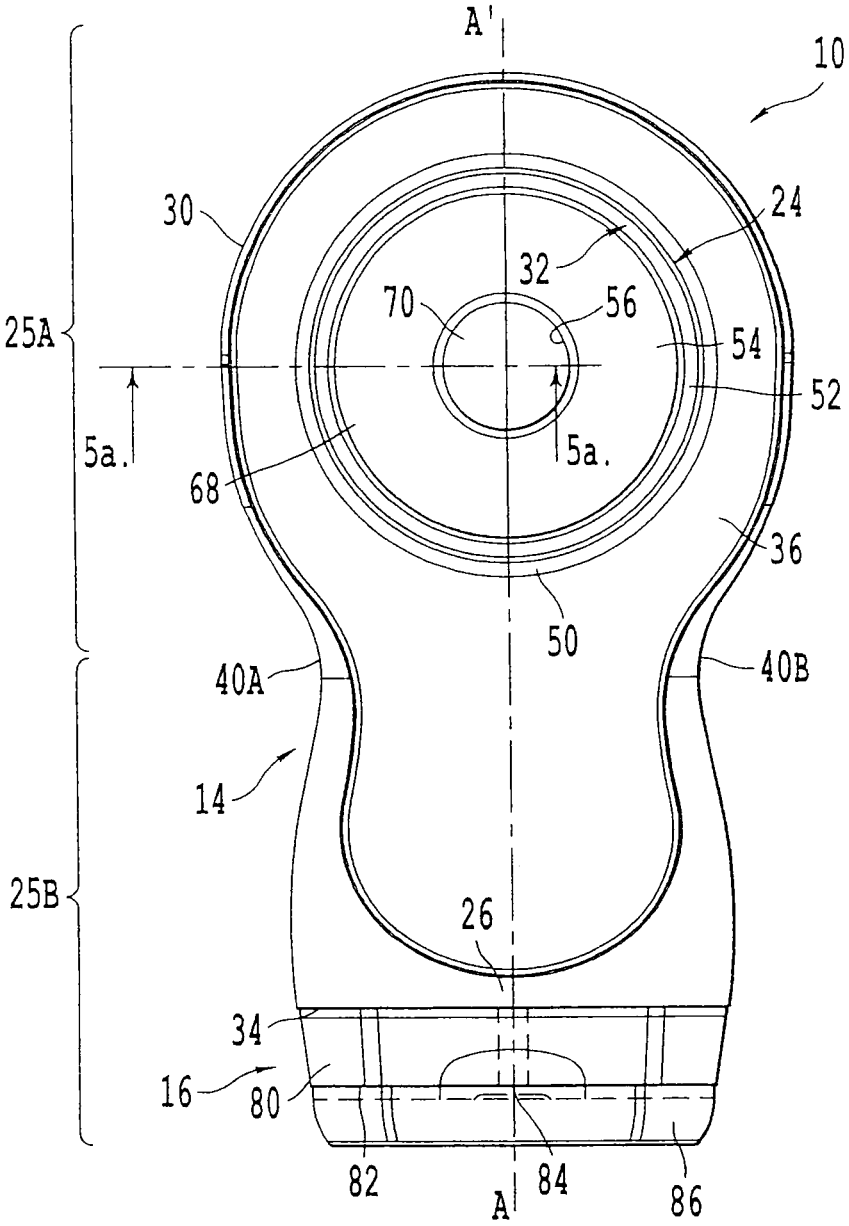
FIG. 4*a* is a view similar to FIG. 1*a*, the cosmetic accessory having been removed from the hollow envelope.

The hollow envelope 14 generally extends along a long axis A-A' which is shown as vertical in FIG. 4*a*.

The hollow envelope 14 defines internally a chamber 22 of cosmetic product and externally a housing 24 for receiving the cosmetic article 18.

In this example the hollow envelope 14 comprises an upper part 25A which is basically axisymmetric about an axis B-B' perpendicular to the axis A-A', and a lower part 25B whose greatest width, measured at right angles to the axis A-A', is less than the greatest width of the upper part 25A. The upper part 25A defines the receiving housing 24 and the lower part 25B carries the head 16.

In this example the hollow envelope 14 is a single moulded part. It may for example be based on a polyolefin such as polypropylene, polyethylene or a PET-type polyester.

The elastic modulus of the material of the hollow envelope 14 is between 60 MPa and 1500 MPa, preferably between 800 MPa and 1500 MPa. As will be seen later, the envelope 14 is thus significantly more rigid than the cosmetic accessory 18.

As illustrated in FIGS. 1*a* to 3*a*, the hollow envelope 14 comprises a front wall 26, a rear wall 28, visible in FIG. 3*a*, and an outer peripheral wall 30 connecting the front wall 26 to the rear wall 28.

The hollow envelope 14 also comprises an inner peripheral wall 32 defining the housing 24 and an end wall 34 on which the dispensing head 16 is mounted.

The front wall 26 has a basically planar main region 36 situated around the through-housing 24 and extending axially towards the lower part 25B of the hollow envelope 14. The planar region forms a supporting surface for the protective film 20.

The rear wall 28 is rounded. It has two concave regions 38 in the upper part 25A of the envelope 14. The concave regions 38 extend parallel to the axis A-A', one on either side of the housing 24. This enables the bottle not to rotate, and to be stable when being filled.

The outer peripheral wall 30 is roughly a cylinder of axis B-B' in the upper part 25A. It has lateral necked regions 40A, 40B between the upper part 25A and the lower part 25B of the hollow envelope 14. The necked regions 40A, 40B are to facilitate the holding of the hollow envelope 14 between the fingers of a user.

The end wall 34 extends approximately transversely relative to the axis A-A' of the end of the lower part 25B. It comprises fixing means (not shown) for the head 16 and a cosmetic product dispensing neck defining an opening for the passage of the product (not visible).

Figure 2A:
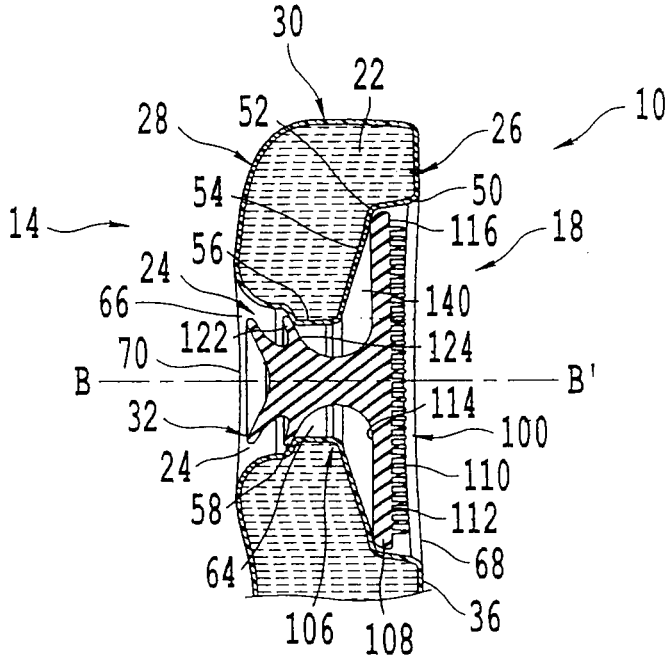
FIG. 2*a* is a view seen in section on the central vertical plane marked II-II in FIG. 1*a;*
Figure 5:
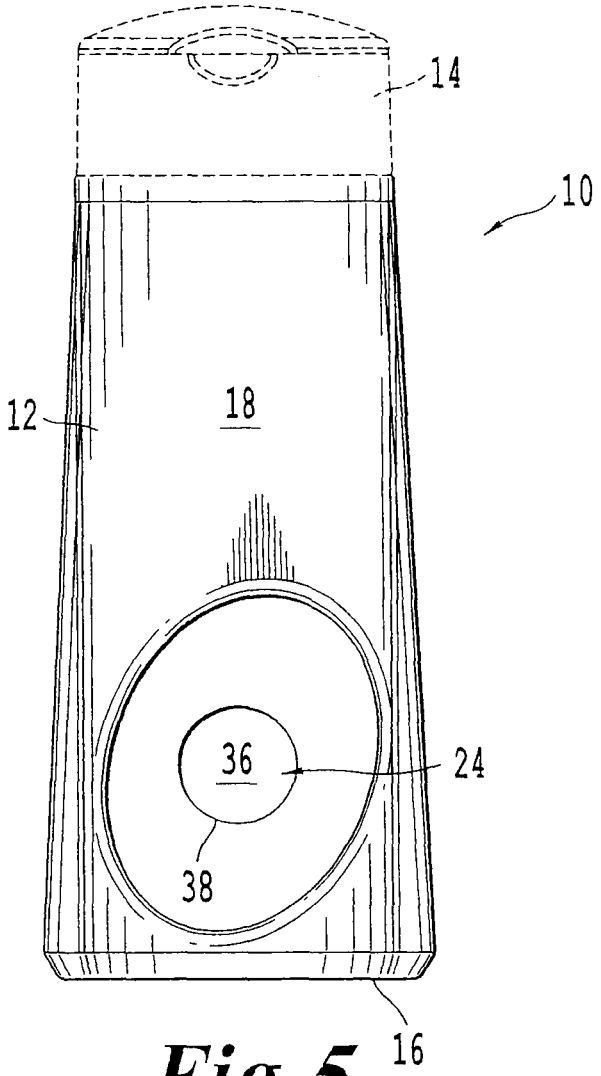
FIG. 5 is a front view of the container of FIG. 4.
Figure 5A:
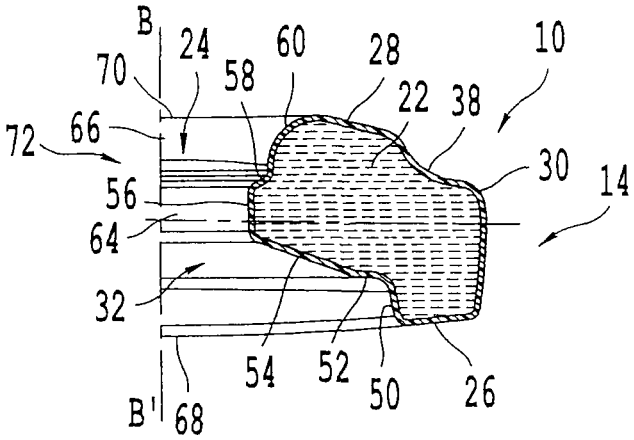
FIG. 5*a* is a partial view, seen in section on the horizontal plane marked V-V in FIG. 4*a;*

As shown in FIGS. 2*a* and 5*a*, the inner peripheral wall 32 is uninterrupted and is axisymmetric about the axis B-B'.

This wall comprises, when proceeding along the axis B-B' from the front wall 26 to the rear wall 28, a basically cylindrical front region 50 of axis B-B', a first bearing surface 52 for the cosmetic accessory 18, a basically frustoconical intermediate region 54, and a central cylindrical region 56 whose lateral dimension is less than that of the front region 50.

The inner peripheral wall 32 also includes a second bearing surface 58 for the cosmetic accessory 18 and a divergent rear region 60.

The front region 50 has a maximum transverse dimension, measured at right angles to the axis B-B', greater than that of all the other regions 52 to 60.

The first bearing surface 52 extends approximately perpendicular to the axis B-B'. It faces out of the housing, towards the front wall 26.

The transverse dimension of the first bearing surface 52 is relatively small. Thus, the annular surface defined by the first bearing surface 52 is less than 50% of the greatest cross section of the housing 24, measured level with the front wall 26.

The radial dimension of the annular surface defined by the first bearing surface 52, measured radially relative to the axis B-B', is less than 30% of the greatest radial dimension of the housing 24, measured level with the front wall.

The frustoconical intermediate region 54 forms an angle of between 5° and 45° to the axis B-B' when projected onto an axial plane passing through this axis.

As will be seen later, the frustoconical region 54 defines towards the rear a space designed to deform the cosmetic accessory 18, and forms a stop for the cosmetic accessory 18 when the latter is inserted into the housing 24.

The frustoconical region 54 faces out of the housing 24 towards the front wall 26. It has a cross-sectional area greater than 30% of the greatest cross-sectional area of the housing 24, projected onto a plane perpendicular to the axis B-B'.

The central cylindrical region 56 comes closer to the axis B-B' than the front region 50 does. Its transverse dimension is less than that of the other regions, so as to form an annular neck in the housing 24.

The second bearing surface 58 is formed by an essentially annular shoulder. It faces out of the housing 24 towards the rear wall 28, in the opposite direction to the first bearing surface 52. It defines an annular surface whose dimension is approximately equal to that of the first bearing surface 52.

The divergent rear region 60 comes out at the rear wall 28. Its transverse cross section increases towards the rear wall 28.

The greatest transverse dimension defined by the rear region 60 is less than the greatest transverse dimension defined by the front region 50.

The regions 50 to 60 define towards the axis B-B' the housing 24.

The housing 24 thus penetrates through the hollow envelope 24 along the axis B-B'. It comprises a front volume 62 whose greatest transverse cross section is in the front region 50 and frustoconical region 54, an intermediate volume 64 whose smallest transverse cross section is in the central cylindrical region 56, and a rear volume 66 of intermediate transverse cross section in the rear region 60.

The housing 24 comes out through the front volume 62 at the front wall 26 in the form of a cosmetic accessory removal opening 68. It comes out at the rear through the rear volume 66 in the rear wall 28 in the form of a secondary opening 70 whose transverse cross section is less than that of the removal opening 68.

The outline of the receiving housing 24 is closed on any cross section perpendicular to the axis B-B'.

The first bearing surface 52 and the second bearing surface 58, which face in opposite directions out of the housing 24, form cosmetic accessory 18 retention means 72 situated in the housing 24.

The walls 26 to 34 define internally the chamber 22 which contains the cosmetic product 12. The only opening of the chamber 22 is the dispensing opening defined in the end wall 34.

The dispensing head 16 comprises a peripheral skirt 80 fixed to the lower wall 34, an end plate 82 defining a product dispensing orifice 84, and a removable closing flap 86 capable of being moved between an orifice 84 closing configuration and an orifice 84 opening configuration.

The chamber 22 opens through the orifice 84 to allow the product 12 contained in the chamber 22 to be dispensed to the exterior, for the purpose of applying it to a body surface of the user.

In accordance with the invention, the cosmetic accessory 18 is received removably in the receiving housing 24 which is defined externally by the hollow envelope 14, through this envelope 14. The cosmetic accessory 18 is thus movable between a storage position, in which the whole of it is received in the housing 24 and engaged in the retention means 72, and a use position, in which the whole of it is removed from the housing 24 and in which it is movable independently of the hollow envelope 14.

In this example the cosmetic accessory 18 is a cosmetic product applicator forming a brush.

The cosmetic accessory 18 comprises an active part 100 for application of cosmetic product. This part is designed to come into contact with a body surface in order to apply cosmetic product to this surface, and a handle 102 allowing the accessory to be held by the user's fingers to allow it to be manipulated.

Additionally, in this example, the cosmetic accessory 18 comprises a sucker 104 mounted on the free end of the handle 102 and a retention member 106 designed to engage with the retention means 72 provided in the housing 24.

The active part 100 comprises a plate 108 and a plurality of bristles 110 projecting from an outward surface 112 of the plate.

In this example the outline of the plate 108 is basically homothetic to the external outline of the housing 24 in the front volume 62. The plate 108 defines an inward surface 114 on the opposite side to the outward surface 112.

As will be seen later, the inward surface 114 is designed to engage, via a first bearing face 116 situated on the outer edge of the plate 108, with the first bearing surface 52 when the cosmetic accessory 18 is engaged in the retention means 72.

The bristles 110 project out from the lower surface 112, on the opposite side to the handle 102.

The handle 102 is formed by a neck 118 which projects inwards along an axis C-C' generally perpendicular to the inward surface 114.

The greatest radial dimension of the handle 102 is less than that of the plate 108 and less than or equal to the smallest radial dimension of the housing 24, measured in the central cylindrical region 56.

The sucker 104 is on the free end of the handle 102. It has a concave inward cavity 120 with its open side turned away from the plate 108.

The retention member 106 is formed by a collar 122 projecting radially away from the axis C-C' with respect to the neck 118. The transverse dimension of the collar 122, measured perpendicular to the axis C-C', is greater than the smallest transverse dimension of the housing 24, measured perpendicular to the axis B-B' in the central cylindrical region 56.

The collar 122 has a second bearing face 124 which faces the upward surface 114 of the active part 100 and extends towards the first bearing face 116.

The second bearing face 124 is designed to engage with the second bearing surface 58, when the cosmetic accessory 18 is received in the housing 24 and engaged in the retention means 72.

Figure 7A:
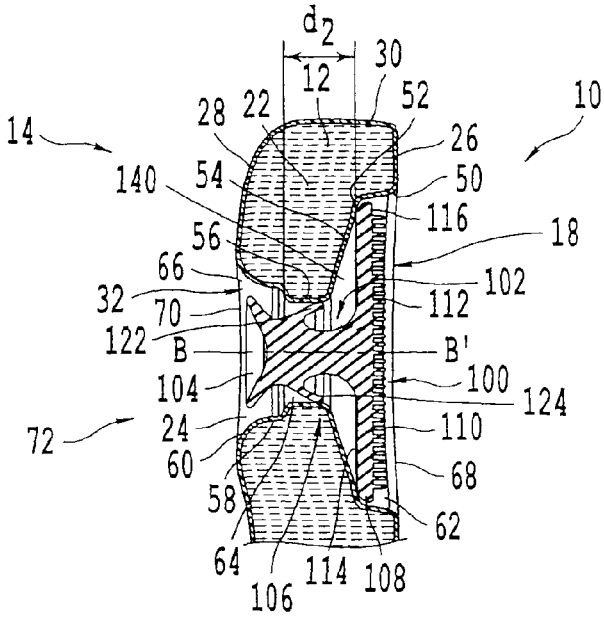
FIG. 7*a* is a view similar to FIG. 2*a*, in an initial stage of the insertion of the cosmetic accessory into its receiving housing.

Referring to FIGS. 6*a* and 7*a*, when the cosmetic accessory 18 is out of the housing 24, as when it is in its use position, the distance d1 between the bearing face 124 of the outer edge 116, measured parallel to the axis C-C', is slightly less, for example between 0.9 times and 0.99 times the distance d2 between the first bearing surface 52 and the second bearing surface 58, measured parallel to the axis B-B'.

Hence, when the cosmetic accessory 18 is received in the housing 24 and engaged in the retention means 72, the cosmetic accessory 18 is held in place under tension between the second bearing face 124 and the first bearing face 114 by the retention means 72.

To this end, according to the invention, the cosmetic accessory 18 is more flexible than the hollow envelope 14, so that at least one face 124 of the cosmetic accessory 18 engaging with the retention means 72 is deformable when the cosmetic accessory 18 is moved from its storage position received in the housing 24 and engaged in the retention means 72, to its removed position outside of the housing 24, without significantly deforming the hollow envelope 14, particularly at the retention means 72.

Figure 9A:
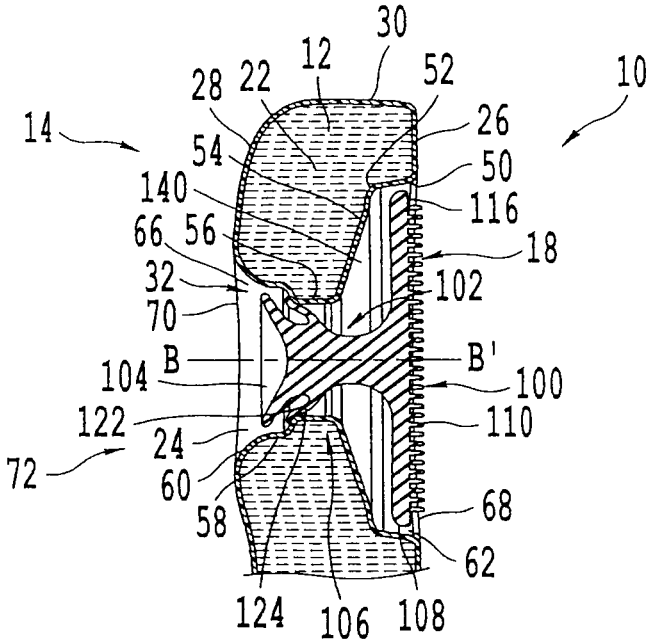
FIG. 9*a* is a view similar to FIG. 7*a*, in a stage of removal of the cosmetic accessory from the receiving housing.

The retention member 106 may for example be produced from a material softer than the material forming the hollow envelope 14 at the retention means 72. The retention member 106 is thus deformable during the removal of the accessory 18 between a radially extended rest position as shown in FIGS. 2*a*, 6*a* and 8*a*, and deformed positions in which it is radially contracted in the vicinity of the handle 102 as shown in FIGS. 7*a* and 9*a*.

In the example illustrated in FIG. 6*a*, the cosmetic accessory 18 is made in one piece based on a material with a hardness less than that of the material of the envelope 14.

The material forming the accessory 18 may for example have an elastic modulus of less than 400 MPa (e.g. if this material is a polyolefin) and advantageously a hardness of less than 70 Shore A and in particular between 20 Shore A and 50 Shore A.

This material may for example be a thermoplastic elastomer (TPE) such as SEBS, SBS, Santoprene, or a polyolefin, or be silicone-based.

The plate 108 is also deformable by bending towards the axis C-C' when the cosmetic accessory 18 is inserted into the housing 24, as will be described later.

Figure 1A:
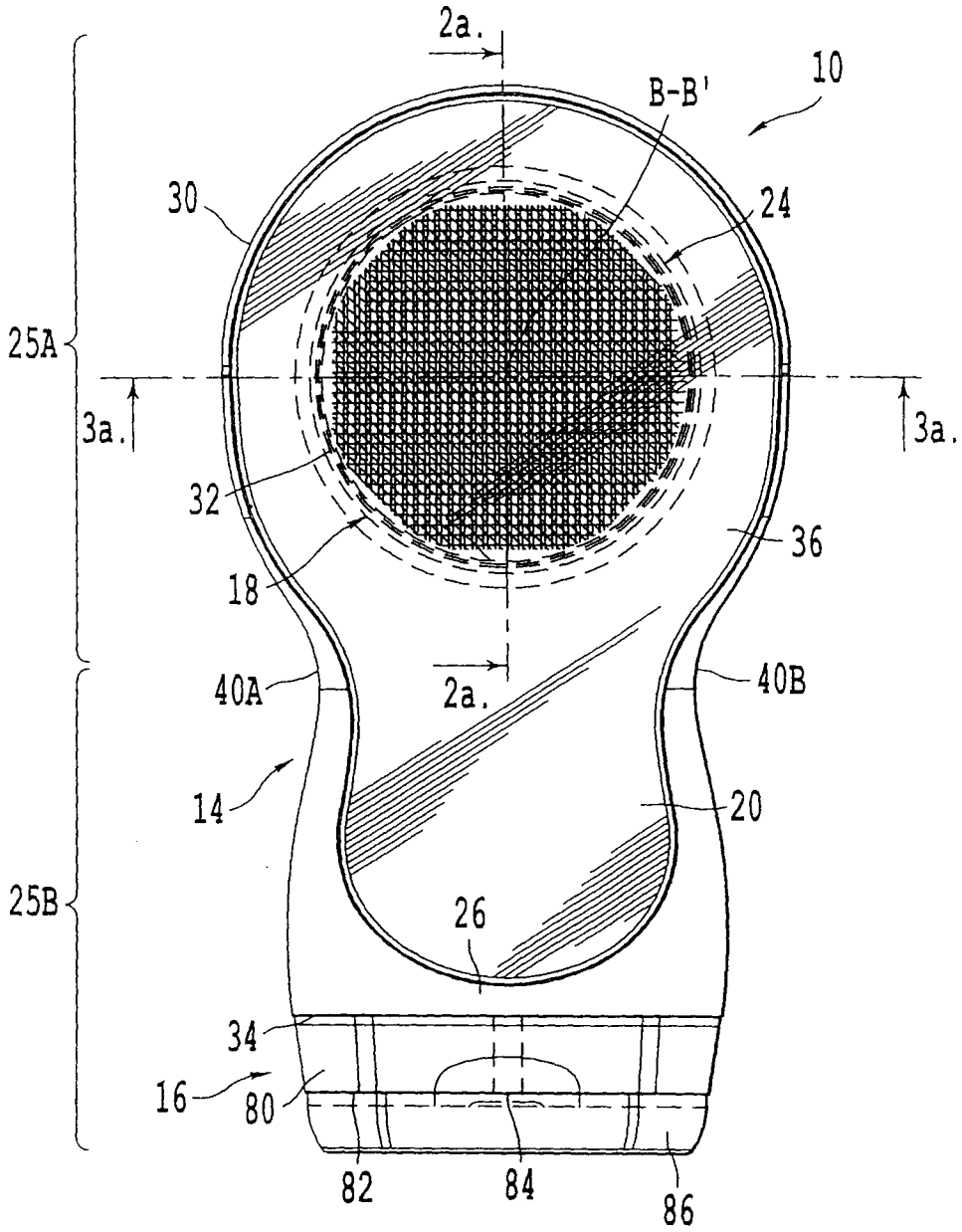
FIG. 1*a* is a front view of a first container according to one preferred embodiment of the invention, prior to its first use.

Referring to FIG. 1*a*, the protective film 20 is bonded adhesively to the planar region 36 of the front wall 26. It closes off the receiving housing 24 towards the exterior, at least prior to the first use of the container 10.

To manufacture the container 10, the hollow envelope 14, the closing head 16 and the cosmetic accessory 18 are made separately and are supplied. At this point the accessory 18 is in its removed position, not in the receiving housing 24.

In this position the distance d1 between the second bearing face 124 and the first bearing face 116 (that on the plate 108) measured parallel to the axis C-C' is at its smallest value.

The collar 122 extends approximately perpendicular to the axis C-C'.

Then, referring to FIG. 7*a*, the cosmetic accessory 18 is engaged in the housing 24, by inserting, in succession, the sucker 104, the handle 102 with the retention member 106, and then the active part 100 through the removal opening 68, in a rearward movement along the axis B-B'.

In the course of this insertion, the sucker 104 and the retention member 106 pass through the central volume 64 of small transverse dimension and contract radially towards the axis C-C' due to being squeezed by the central region 56. The second bearing face 124 moves closer to the handle 102, towards the active part 100, as illustrated in FIG. 7*a*.

The central region 56 and the retention means 72 do not deform significantly during the movement of the retention member 106.

The outer edge 116 of the plate 108 then makes contact with the first bearing surface 52. Next, as illustrated by FIG. 8*a*, pressure is applied to the active part 100 through the removal opening 68 in the direction of the secondary opening 70 to cause the second bearing face 124 to advance beyond the central region 56 into the rear volume 66.

To this end, the plate 108 bends towards the axis C-C' in the space 140 available between the inward surface 114 and the frustoconical region 54. Bending of the plate is limited axially rearwardly by the frustoconical region 54.

This moves the handle 102 rearwards and allows the retention member 106 to be advanced within the rear volume 66 axially beyond the second bearing surface 58.

The retention member 106 now expands radially away from the axis C-C' so that its greatest transverse dimension is greater than the greatest transverse dimension of the central cylindrical region 56.

The pressure on the plate 108 is now released. As shown in FIG. 2*a*, the second bearing face 124 is now pressed against the second bearing surface 58.

The distance between the second bearing face 124 and the first bearing face 116, measured perpendicular to the axis C-C', thus becomes equal to the distance d2 between the first bearing surface 52 and the second bearing surface 58. This distance is greater than the distance d1 between the second bearing face 124 and the first bearing face 116, measured at rest when the cosmetic accessory 18 is not in the housing 24.

The cosmetic accessory 18 is therefore held under slight tension in the housing 24 by means of the retention member 106 and the active part 100.

The cosmetic accessory 18 is now in its storage position, retained in the housing 24. In this position the whole of the accessory 18 is contained within the housing 24, without projecting out of the housing 24 beyond the front wall 26 or beyond the rear wall 28.

As a result, the cosmetic accessory 18 is retained in a highly reliable and firm manner within the housing 24. This makes it easy to handle when filling the chamber 22 with cosmetic product 12 and/or during the transport and subsequent packaging of the container 10.

Furthermore, since no part of the accessory 18 projects out of the housing 24, the container 10 takes up little space. This allows it to be mass-produced on a production line without the risk of interference between individual finished containers 10.

After this, the chamber 22 is filled with cosmetic product 12 and the applicator head 16 is fitted on the end of the hollow envelope 14.

The adhesive protective film 20 can then be placed on the planar region 36 without interfering with the cosmetic accessory 18, which is held securely in the housing 24 without projecting beyond the front wall 26.

The operation of the container 10 according to the invention during its use will now be described.

Initially, the user withdraws the protective film 20 to reveal the removal opening 68.

The user then applies pressure to the cosmetic accessory 18 in a direction from the secondary opening 70 towards the removal opening 68 by for example inserting a finger into the housing 24 through the secondary opening 70.

As shown in FIG. 9*a*, this pressure deforms the retention member 106 radially towards the handle 102 and towards the free end of the handle 102, owing to its contact with the central region 56.

The retention member 106 then slides off the second bearing surface 58 and slides in the direction of the axis B-B' against the central cylindrical region 56, towards the removal opening 68, until it enters the front volume 62. This movement carries the active part 100 through the removal opening 68 and out of the housing 24.

The central region 56 and the retention means 72 are not significantly deformed by the passage of the retention member 106.

The active part 100 can then be grasped by the user to withdraw the accessory 18 completely from the housing 24.

Removal of the cosmetic accessory 18 is therefore a very simple, user-friendly action.

Next, the user opens the closing flap 86 and exposes the dispensing orifice 84 so as to remove some of the cosmetic product 12 from the chamber 22. The user may apply it directly to a body surface or to the outward surface 112 of the cosmetic accessory 18 between the bristles 110.

Once application of the cosmetic product is completed, the user may attach the cosmetic accessory 18 to a surface, situated for example in the bathroom, by means of the sucker 104. Alternatively the user may insert the accessory 18 back into the receiving housing 24 and re-engage it in the retention means 72, as described above.

In a variant, the cosmetic accessory 18 includes a part that is stiffer than the retention member 106, for example on the handle 102.

In another variant, the active part 100 of the cosmetic accessory is formed by an applicator fitted with a piece of foam, felt, nonwoven material, or with a sponge, a brush with coaxially mounted bristles, a brush with bristles mounted transversely on a twisted or injection-moulded core, or with a comb, spatula, razor, or roller.

The active part may also form or include a cosmetic treatment tool such as a scraper, a massage roller, a cuticle pusher or a nail file.

More generally, the cosmetic accessory 18 is not necessarily provided with a sucker 104 on its free end.

In a variant, the sucker 104 defines the bearing face 124 on a bearing surface 58 of the retention means 72.

In yet another variant, the housing 24 is a blind housing. Access to the housing 24 and to the cosmetic accessory 18 is through the removal opening 18 only.

In still another variant, the outline of the transverse cross section of the housing 24 is elongated, as for example an oval or an ellipse, or polygonal, such as triangular, square or rectangular.

Preferred embodiments of the invention include:

1. Container (10) of the type comprising:
   a hollow envelope (14) defining internally a chamber (22) for cosmetic product, the hollow envelope (14) defining externally a receiving housing (24) for a cosmetic accessory; and
   a cosmetic accessory (18) designed to be received removably in the receiving housing (24), at least a part of the cosmetic accessory (18) being more flexible than the hollow envelope (14);
   characterized in that the hollow envelope (14) comprises, in the receiving housing (24), retention means (72) for retaining the cosmetic accessory, the whole of the cosmetic accessory (18) being received in the receiving housing (24) without projecting outside of the receiving housing (24) beyond the hollow envelope when the cosmetic accessory (18) is engaged in the retention means (72).
2. Container (10) according to embodiment 1, characterized in that the cosmetic accessory (18) comprises a retention surface (124) that engages with the retention means (72), the retention surface (124) being deformable without significant deformation of the retention means (72) when the cosmetic accessory (18) is removed from the receiving housing (24).
3. Container (10) according to any one of the preceding embodiments, characterized in that the receiving housing (24) is a through-housing.
4. Container (10) according to embodiment 3, characterized in that the through-housing (24) opens out at a cosmetic accessory removal opening (68) on one side of the hollow envelope (14), and opens out at a secondary opening (70) on another side of the hollow envelope (14), opposite the removal opening (68), the secondary opening (70) having in particular a cross section smaller than the cross section of the removal opening (68).
5. Container (10) according to any one of the preceding embodiments, characterized in that the retention means (72) comprise a first bearing surface (52) for the cosmetic accessory and a second bearing surface (58) for the cosmetic accessory, the bearing surfaces (52, 58) being separated axially along an axis (B-B') along which the cosmetic accessory is removed from the receiving housing (24).
6. Container (10) according to embodiment 5, characterized in that the first bearing surface (52) and the second bearing surface (58) face in opposite directions to each other, the cosmetic accessory (18) being held under tension between the first bearing surface (52) and the second bearing surface (58) when the cosmetic accessory (18) is engaged in the retention means (72).
7. Container (10) according to any one of the preceding embodiments, characterized in that the receiving housing (24) defines a cosmetic accessory deforming space (140) situated between the cosmetic accessory (18) and the hollow envelope (14) when the cosmetic accessory (18) is engaged in the retention means (72), the cosmetic accessory (18) being deformable in the deforming space (140) without significant deformation of the retention means (72).
8. Container (10) according to any one of the preceding embodiments, characterized in that the hollow envelope (14) defines a back region (54) that projects into the receiving housing (24) transversely with respect to an axis (B-B') along which the cosmetic accessory (18) is removed from the receiving housing (24), the cosmetic accessory (18) being situated at a distance from the back region (54) when the cosmetic accessory (18) is engaged in the retention means (72), and the back region (54) advantageously diverging outwards away from the receiving housing (24).
9. Container (10) according to any one of the preceding embodiments, characterized in that the receiving housing (24) opens through a cosmetic accessory removal opening (68), the removal opening (68) being defined by a surface (36) of the hollow envelope that is basically planar all the way around the periphery of the removal opening (68).
10. Container (10) according to any one of the preceding embodiments, characterized in that the outline of the receiving housing (24) is closed on every cross section perpendicular to an axis (B-B') of removal of the cosmetic accessory from the receiving housing (24).
11. Container (10) according to any one of the preceding embodiments, characterized in that the cosmetic accessory (18) comprises a sucker (104).
12. Container (10) according to any one of the preceding embodiments, characterized in that the cosmetic accessory (18) comprises an active part (100) designed to come into contact with a body surface to carry out a cosmetic treatment of the surface, and a handle (102) which projects from the active part (100), the cosmetic accessory (18) also comprising a member (106) for its retention on the hollow envelope, the retention member (106) projecting from the handle (102) and being at a distance from the active part (100).
13. Container (10) according to any one of the preceding embodiments, characterized in that the cosmetic applicator (18) is a single moulding, advantageously in a material with a hardness less than the material forming the hollow envelope.
14. Cosmetic accessory (18) suitable for reception in a container (10) according to any one of the preceding embodiments, characterized in that it comprises:
   an active part (100) designed to come into contact with a body surface to carry out a cosmetic treatment; and
   a handle (102) that projects from the active part (100);
   characterized in that the cosmetic accessory (18) comprises a sucker (104) on the free end of the handle (102) and a retention member (106) suitable for engaging with retention means (72) on the container, the retention member (106)

projecting from the handle (102) and being situated between the sucker (104) and the active part (100).

15. Cosmetic treatment method characterized in that it comprises the following steps:
   provision of a container (10) according to any one of embodiments 1 to 13, the whole of the cosmetic accessory (18) being received in the receiving housing (24), not projecting from the receiving housing (24) beyond the hollow envelope (14), and being engaged in the retention means (72);
   deformation of at least a part of the cosmetic accessory (18) in the receiving housing (24), without significant deformation of the retention means (72), in order to release the cosmetic accessory (18) from the retention means (72);
   removal of the cosmetic accessory (18) from the receiving housing (24); and
   application of the cosmetic accessory (18) to a body surface in order to carry out a cosmetic treatment, especially after having applied a cosmetic product to the body surface.

A preferred container embodiment herein (10) comprises a hollow envelope (14) defining internally a chamber (22) for cosmetic product, the hollow envelope (14) defining externally a receiving housing (24) for a cosmetic accessory (18).

The container (10) preferably comprises a cosmetic accessory (18) designed to be received removably in the receiving housing (24), at least a part of the cosmetic accessory (18) being more flexible than the hollow envelope (14).

The hollow envelope (14) preferably comprises, in the receiving housing (24), retention means (72) for retaining the cosmetic accessory. The whole of the cosmetic accessory (18) is received in the receiving housing (24) without projecting outside of the receiving housing (24) beyond the hollow envelope (14) when the cosmetic accessory (18) is engaged in the retention means (72).

In another preferred embodiment a container system is provided having a container and a tool that is easily stored within the container. Specifically, a container is provided having a tool retainer for accommodating the tool. Further, a reusable tool is provided that is configured to rest in the tool retainer. Thus, the coordinating container and tool greatly facilitate the storage and transport of the container and tool in one system.

Further preferred embodiments of the invention include:

1a. A container, comprising:
   a housing having a first wall and a second wall remote therefrom;
   a depth d associated with a distance between the first and second walls; and
   an aperture in the housing configured to retain a tool, wherein the aperture extends between the first and second walls and has a varying size along the depth d.

2a. The container of embodiment 1a, further comprising a means for removably fastening the tool to the aperture.

3a. The container of embodiment 2a, wherein the means for removably fastening the tool to the aperture comprises a pressure fit.

4a. The container of embodiment 2a, wherein the means for removably fastening the tool to the aperture comprises a snap fit.

5a. The container of embodiment 1a, wherein the aperture has a first wall recession adjacent the first wall.

6a. The container of embodiment 5a, wherein the aperture has a second recession adjacent the second wall.

7a. The container of embodiment 6a, wherein the aperture has a opening connecting the first and second wall recessions.

8a. The container of embodiment 1a, wherein the tool is entirely contained between the first and second walls.

9a. The container of embodiment 1a, wherein a portion of the tool protrudes from outside a first and/or second wall.

10a. The container of embodiment 1a, wherein the aperture has a varying shape along depth d.

11a. A container system, comprising:
   a tool, comprising:
      a first end; and
      a second end remote therefrom; and
   a container, comprising:
      a housing having a first wall and a second wall remote therefrom;
      a depth d associated with a distance between the first and second walls; and
      an aperture in the housing configured to retain a tool, wherein the aperture extends between the first and second walls and has a varying size along the depth d.

12a. The container embodiment of claim 11a, wherein the aperture has a first wall recession adjacent the first wall.

13a. The container embodiment of claim 11a, wherein the aperture has a second recession adjacent the second wall.

14a. The container embodiment of claim 11a, wherein the tool is entirely contained between the first and second walls.

15a. The container embodiment of claim 11a, wherein the tool has a spool-like shape.

16a. The container embodiment of claim 11a, wherein the second end of the tool has a means for releasably fastening to a substrate.

17a. The container embodiment of claim 16a, wherein the means for releasably fastening to the substrate is a hook, a suction cup, or a string.

18a. A container, comprising:
   a housing having a first wall and a second wall remote therefrom; and
   a recession at the first wall, extending toward the second wall, at a depth d, configured to retain a tool, wherein a size of the recession varies along the depth d.

19a. The container of embodiment 18a, wherein the tool lies entirely within the container.

20a. The container of embodiment 18a, wherein the recession includes a flange for retaining the tool.

21a. The container of embodiment 18a, wherein the recession permits the tool to be snap fitted.

22a. A container comprising:
   a hollow envelope defining internally a chamber for a cosmetic product, the hollow envelope defining externally a receiving housing for a cosmetic accessory; and
   a cosmetic accessory designed to be received removably in the receiving housing, at least a part of the cosmetic accessory being more flexible than the hollow envelope;
   wherein the hollow envelope comprises, in the receiving housing, a retainer for retaining the cosmetic accessory, the whole of the cosmetic accessory being received in the receiving housing without projecting outside of the receiving housing beyond the hollow envelope when the cosmetic accessory is engaged in the retainer.

23a. The container according to embodiment 22a, wherein the cosmetic accessory comprises a retention surface that engages with the retainer, the retention surface being deformable without significant deformation of the retainer when the cosmetic accessory is removed from the receiving housing.

24a. The container according to embodiment 22a, wherein the receiving housing is a through-housing.

25a. The container according to embodiment 24a, wherein the through-housing opens out at a cosmetic accessory removal opening on one side of the hollow envelope, and opens out at a secondary opening on another side of the hollow envelope, opposite the removal opening, the secondary opening having in particular a cross section smaller than the cross section of the removal opening.

26a. The container according to embodiment 22a, wherein the retainer comprises a first bearing surface for the cosmetic accessory and a second bearing surface for the cosmetic accessory, the bearing surfaces being separated axially along an axis (B-B') along which the cosmetic accessory is removed from the receiving housing.

27a. The container according to embodiment 26a, wherein the first bearing surface and the second bearing surface face in opposite directions to each other, the cosmetic accessory being held under tension between the first bearing surface and the second bearing surface when the cosmetic accessory is engaged in the retainer.

28a. The container according to embodiment 22a, wherein the receiving housing defines a cosmetic accessory deforming space situated between the cosmetic accessory and the hollow envelope when the cosmetic accessory is engaged in the retainer, the cosmetic accessory being deformable in the deforming space without significant deformation of the retainer.

29a. The container according to embodiment 22a, wherein the hollow envelope defines a back region that projects into the receiving housing transversely with respect to an axis (B-B') along which the cosmetic accessory is removed from the receiving housing, the cosmetic accessory being situated at a distance from the back region when the cosmetic accessory is engaged in the retainer.

30a. The container according to embodiment 29a, wherein the back region diverges outwards away from the receiving housing.

31a. The container according to embodiment 22a, wherein the receiving housing opens through a cosmetic accessory removal opening, the removal opening being defined by a surface of the hollow envelope that is basically planar all the way around the periphery of the removal opening.

32a. The container according to Claim 22a, wherein the outline of the receiving housing is closed on every cross section perpendicular to an axis (B-B') of removal of the cosmetic accessory from the receiving housing.

33a. The container according to embodiment 22a, wherein the cosmetic accessory comprises a sucker.

34a. The container according to embodiment 22a, wherein the cosmetic accessory comprises an active part designed to come into contact with a body surface to carry out a cosmetic treatment of the surface, and a handle which projects from the active part, the cosmetic accessory also comprising a member for its retention on the hollow envelope, the retention member projecting from the handle and being at a distance from the active part.

35a. The container according to embodiment 22a, wherein the cosmetic applicator is a single moulding.

36a. The container according to embodiment 35a, wherein the cosmetic applicator is a single moulding in a material with a hardness less than the material forming the hollow envelope.

37a. A cosmetic accessory suitable for reception in a container according to embodiment 22a, the accessory comprising:

an active part designed to come into contact with a body surface to carry out a cosmetic treatment; and a handle that projects from the active part;

wherein the cosmetic accessory comprises a sucker on the free end of the handle and a retention member suitable for engaging with the retainer on the container, the retention member projecting from the handle and being situated between the sucker and the active part.

38a. A cosmetic treatment method comprising:

grasping a container according to embodiment 22a, the whole of the cosmetic accessory being received in the receiving housing, not projecting from the receiving housing beyond the hollow envelope, and being engaged in the retainer, deformation of at least a part of the cosmetic accessory in the receiving housing, without significant deformation of the retainer in order to release the cosmetic accessory from the retainer;

removal of the cosmetic accessory from the receiving housing; and application of the cosmetic accessory to a body surface in order to carry out a cosmetic treatment.

39a. A cosmetic treatment method according to embodiment 38a, wherein application of the cosmetic accessory to a body surface in order to carry out a cosmetic treatment occurs after having applied a cosmetic product to the body surface.

The above written description of the invention provides a manner and process of making and using it such that any person skilled in this art is enabled to make and use the same, this enablement being provided in particular for the subject matter of the appended claims, which make up a part of the original description.

As used herein, the phrases "selected from the group consisting of," "chosen from," and the like include mixtures of the specified materials. Terms such as "contain(s)" and the like as used herein are open terms meaning 'including at least' unless otherwise specifically noted. The term "mentioned" notes exemplary embodiments, and is not limiting to certain species. As used herein the words "a" and "an" and the like carry the meaning of "one or more."

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the invention may not show every benefit of the invention, considered broadly.

The invention claimed:

1. A container, comprising:

a housing comprising a first wall and a second wall remote therefrom;

a depth d associated with a distance between the first and second walls; and an aperture in the housing configured to retain a tool, wherein the aperture extends between the first and second walls and has a varying size along the depth d, wherein the aperture has a first wall recession adjacent the first wall, a second recession adjacent the second wall, and wherein the aperture has an opening connecting the first and second wall recessions and the opening has a smaller diameter than the first wall recession and the second wall recession, wherein said container comprises a cosmetic product.

2. The container of claim 1, further comprising a fastener for removably fastening the tool to the aperture.

3. The container of claim 1, wherein the aperture has a first wall recession adjacent the first wall, a second recession adjacent the second wall, and wherein the aperture has a opening connecting the first and second wall recessions.

4. The container of claim 1, wherein the tool is entirely contained between the first and second walls.

5. A container system, comprising:

a tool, comprising:

a first end; and a second end remote therefrom wherein said tool is detachable from a container according to claim 1.

6. The container system of claim 5, wherein the aperture has a first wall recession adjacent the first wall, a second recession adjacent the second wall, and wherein the tool is entirely contained between the first and second walls.

7. The container system of claim 5, wherein the second end of the tool has a releasable fastener for releasably fastening to a substrate, wherein the releasable fastener is a hook, a suction cup, or a string.

8. A container, comprising:

a housing comprising a first wall and a second wall remote therefrom; and a recession at the first wall, extending toward the second wall, at a depth d, configured to retain a tool, wherein a size of the recession varies along the depth d, wherein the recession has a first wall recession adjacent the first wall, a second wall recession adjacent the second wall, and wherein the recession has an opening connecting the first and second wall recessions and the opening has a smaller diameter than the first wall recession and the second wall recession, wherein said container comprises a cosmetic product.

9. A container comprising:

a hollow envelope defining internally a chamber for a cosmetic product, the hollow envelope defining externally a receiving housing for a cosmetic accessory; and a cosmetic accessory designed to be received removably in the receiving housing, at least a part of the cosmetic accessory being more flexible than the hollow envelope;

wherein the hollow envelope comprises, in the receiving housing, a retainer for retaining the cosmetic accessory, the whole of the cosmetic accessory being received in the receiving housing without projecting outside of the receiving housing beyond the hollow envelope when the cosmetic accessory is engaged in the retainer, wherein the receiving housing is a though-housing and the through-housing opens out at a cosmetic accessory removal opening on one side of the hollow envelope, and opens out at a secondary opening on another side of the hollow envelope, opposite the removal opening, the secondary opening having in particular a cross section smaller than the cross section of the removal opening.

10. The container according to claim 9, wherein the cosmetic accessory comprises a retention surface that engages with the retainer, the retention surface being deformable without significant deformation of the retainer when the cosmetic accessory is removed from the receiving housing.

11. The cosmetic container of claim 1, wherein the tool has a first end and a second end so that the second end of the aperture has a cross-section that is smaller than the cross-section of the first end.

12. The cosmetic container of claim 1, wherein the cosmetic product is a product for the skin or body.

13. The container according to claim 9, wherein the retainer comprises a first bearing surface for the cosmetic accessory and a second bearing surface for the cosmetic accessory, the bearing surfaces being separated axially along an axis (B-B') along which the cosmetic accessory is removed from the receiving housing.

14. The container according to claim 13, wherein the first bearing surface and the second bearing surface face in opposite directions to each other, the cosmetic accessory being held under tension between the first bearing surface and the second bearing surface when the cosmetic accessory is engaged in the retainer.

15. The container according to claim 9, wherein the receiving housing defines a cosmetic accessory deforming space situated between the cosmetic accessory and the hollow envelope when the cosmetic accessory is engaged in the retainer, the cosmetic accessory being deformable in the deforming space without significant deformation of the retainer.

16. The container according to claim 9, wherein the hollow envelope defines a back region that projects into the receiving housing transversely with respect to an axis (B-B') along which the cosmetic accessory is removed from the receiving housing, the cosmetic accessory being situated at a distance from the back region when the cosmetic accessory is engaged in the retainer.

17. The container according to claim 9, wherein the cosmetic accessory comprises an active part designed to come into contact with a body surface to carry out a cosmetic treatment of the surface, and a handle which projects from the active part, the cosmetic accessory also comprising a member for its retention on the hollow envelope, the retention member projecting from the handle and being at a distance from the active part.

18. A cosmetic accessory suitable for reception in a container according to claim 9, the accessory comprising:

an active part designed to come into contact with a body surface to carry out a cosmetic treatment; and a handle that projects from the active part;

wherein the cosmetic accessory comprises a sucker on the free end of the handle and a retention member suitable for engaging with the retainer on the container, the retention member projecting from the handle and being situated between the sucker and the active part.

19. A cosmetic treatment method comprising:

grasping a container according to claim 9, the whole of the cosmetic accessory being received in the receiving housing, not projecting from the receiving housing beyond the hollow envelope, and being engaged in the retainer, deforming at least a part of the cosmetic accessory in the receiving housing, without significant deformation of the retainer in order to release the cosmetic accessory from the retainer;

removing the cosmetic accessory from the receiving housing; and applying the cosmetic accessory to a body surface in order to carry out a cosmetic treatment.

* * * * *